US009352326B2

(12) United States Patent
Lee

(10) Patent No.: US 9,352,326 B2
(45) Date of Patent: May 31, 2016

(54) GRIND MILL FOR DRY MILL INDUSTRY

(71) Applicant: Chie Ying Lee, Fremont, CA (US)

(72) Inventor: Chie Ying Lee, Fremont, CA (US)

(73) Assignee: Lee Tech LLC, San Jose, CA (US)

( * ) Notice: Subject to any disclaimer, the term of this patent is extended or adjusted under 35 U.S.C. 154(b) by 393 days.

(21) Appl. No.: 13/892,961

(22) Filed: May 13, 2013

(65) Prior Publication Data

US 2014/0110512 A1 Apr. 24, 2014

Related U.S. Application Data

(60) Provisional application No. 61/717,431, filed on Oct. 23, 2012.

(51) Int. Cl.
*B02C 7/12* (2006.01)

(52) U.S. Cl.
CPC ..... *B02C 7/12* (2013.01)

(58) Field of Classification Search
CPC ..... B02C 17/12
USPC ..... 241/296–298, 261.2, 261.3
See application file for complete search history.

(56) References Cited

U.S. PATENT DOCUMENTS

| | | | | |
|---|---|---|---|---|
| 2,600,903 | A | 6/1952 | Miller | |
| 3,827,423 | A | 8/1974 | Bolitho | |
| 3,975,546 | A | 8/1976 | Stahmann | |
| 4,171,383 | A | 10/1979 | Chwalek et al. | |
| 4,255,518 | A | 3/1981 | Muller et al. | |
| 4,313,061 | A | 1/1982 | Thomas | |
| 4,341,713 | A | 7/1982 | Stolp et al. | |
| 4,396,161 | A | 8/1983 | Ruokolainen et al. | |
| 4,635,864 | A * | 1/1987 | Peterson | D21D 1/306 241/251 |
| 5,177,008 | A | 1/1993 | Kampen | |
| 5,244,159 | A * | 9/1993 | Newnan | B02C 7/04 241/261.3 |
| 5,248,099 | A | 9/1993 | Lahner et al. | |
| 5,364,335 | A | 11/1994 | Franzen et al. | |
| 6,190,462 | B1 | 2/2001 | Markland et al. | |
| 6,254,914 | B1 | 7/2001 | Singh et al. | |

(Continued)

FOREIGN PATENT DOCUMENTS

| | | | |
|---|---|---|---|
| DE | 4239342 | A1 | 5/1994 |
| EP | 0772978 | B1 | 11/1999 |

(Continued)

OTHER PUBLICATIONS

International Search Report and Written Opinion from PCT Application No. PC/US15/47577.

*Primary Examiner* — Mark Rosenbaum
(74) *Attorney, Agent, or Firm* — Haverstock & Owens LLP

(57) ABSTRACT

A disc mill includes an inlet configured to provide solid material for grinding to the grind plates in a smooth and constant manner. A solid ring is added around an outer circumference of the grind plates to control the grinded solid discharge rate. In some embodiments, the grind plates are configured with constant solid path way open area from row to row. The grind surface and solid pass way open area are maximized by increasing the relative tooth height compared to the tooth width. The teeth can be positioned according to a block channel configurations so as to force the solid material to pass along the grind surface of each row. A grind plate design program is used to enable conjunction of the design parameters with application variation, thereby enabling the optimum grind plate design to meeting various applications needed.

32 Claims, 30 Drawing Sheets

(56) References Cited

U.S. PATENT DOCUMENTS

| | | | |
|---|---|---|---|
| 6,899,910 | B2 | 5/2005 | Johnston et al. |
| 7,563,469 | B1 | 7/2009 | Navarro et al. |
| 2002/0122944 | A1 | 9/2002 | Ogle et al. |
| 2004/0087808 | A1 | 5/2004 | Prevost et al. |
| 2004/0187863 | A1 | 9/2004 | Langhauser |
| 2005/0009133 | A1 | 1/2005 | Johnston et al. |
| 2007/0184541 | A1 | 8/2007 | Karl et al. |
| 2007/0210007 | A1 | 9/2007 | Scheimann et al. |
| 2009/0093027 | A1 | 4/2009 | Balan et al. |
| 2009/0227004 | A1 | 9/2009 | Dale |
| 2010/0093860 | A1 | 4/2010 | Boon et al. |
| 2010/0159552 | A1 | 6/2010 | Benson et al. |
| 2010/0260918 | A1 | 10/2010 | Wang |
| 2011/0086149 | A1 | 4/2011 | Bootsma |
| 2011/0100359 | A1 | 5/2011 | North |
| 2011/0123657 | A1 | 5/2011 | Vandenbroucke et al. |
| 2011/0177560 | A1 | 7/2011 | Galvez, III et al. |
| 2011/0250312 | A1 | 10/2011 | Lewis |
| 2011/0283602 | A1 | 11/2011 | Gallop et al. |
| 2012/0077232 | A1 | 3/2012 | Budaraju et al. |
| 2012/0168387 | A1 | 7/2012 | Tran et al. |
| 2012/0199531 | A1 | 8/2012 | Winsness |
| 2012/0244590 | A1 | 9/2012 | Lee |
| 2012/0252065 | A1 | 10/2012 | Rozenszain et al. |
| 2012/0270275 | A1 | 10/2012 | Fenton et al. |
| 2014/0242251 | A1 | 8/2014 | Bootsma |

FOREIGN PATENT DOCUMENTS

| | | | |
|---|---|---|---|
| GB | 852995 | A | 11/1960 |
| WO | 01/14595 | A2 | 3/2001 |
| WO | 2012/075481 | A1 | 6/2012 |
| WO | 2012145230 | A1 | 10/2012 |
| WO | 2012160191 | A2 | 11/2012 |

* cited by examiner

Block channel view

% Active (overlap )Grind surface decreae VS two plate distant gap setting

| | | Two grind plate distant apart, inch | | | | | |
|---|---|---|---|---|---|---|---|
| tooth height | | 0 | 0.1 | 0.2 | 0.3 | 0.4 | 0.5 |
| 0.4 | 0.4 inch tooth height | 100.00 | 75.00 | 50.00 | 25.00 | 0.00 | -25.00 |
| 0.5 | 0.5 inch tooth height | 100.00 | 80.00 | 60.00 | 40.00 | 20.00 | 0.00 |
| 0.6 | 0.6 inch tooth height | 100.00 | 83.33 | 66.67 | 50.00 | 33.33 | 16.67 |
| 0.7 | 0.7 inch tooth height | 100.00 | 85.71 | 71.43 | 57.14 | 42.86 | 28.57 |
| 0.8 | 0.8 inch tooth height | 100.00 | 87.50 | 75.00 | 62.50 | 50.00 | 37.50 |
| 0.9 | 0.9 inch tooth height | 100.00 | 88.89 | 77.78 | 66.67 | 55.56 | 44.44 |
| 1 | 1inch tooth height | 100.00 | 90.00 | 80.00 | 70.00 | 60.00 | 50.00 |
| 1.1 | 1.1 inch tooth height | 100.00 | 90.91 | 81.82 | 72.73 | 63.64 | 54.55 |
| 1.2 | 1,2 inch tooth height | 100.00 | 91.67 | 83.33 | 75.00 | 66.67 | 58.33 |

The Optmium Plate Gap Setting VS Solid Pass Way Open Area

Summary of key data on prior art 36 inch grind plate design

Current grind plate design for 36 inch single/double disc grind mill and lower ring grind plate 52 inch single disc grind mill

| 0.09 | 0.52 | 6 | | Tooth on radius position, i | | | Height dimension | | Tooth profile, inch | | | Number | tooth length and space | | | Solid open | Active grind |
|---|---|---|---|---|---|---|---|---|---|---|---|---|---|---|---|---|---|
| Number of r | | Zig Zip path | | tooth base | | | Valley | tooth | Tip | between two | | of tooth | Length | space | ratio | area at | surface area |
| | | bottom | top | out edge | inner | center | deep | height | wide | tip gap | side ga | per plate | L | D | D/L | 0.15" gap | at 0.15" gap |
| 1 | | 0.74 | 0.36 | 17.91 | 17.17 | 17.54 | 0.53 | 0.53 | 0.188 | 0 | 0.086 | 13 | 0.94 | 0.47 | 1.54 | 36.08 | 55.72 |
| | 1 | 0.74 | 0.36 | 17.36 | 16.62 | 16.99 | 0.53 | 0.53 | 0.188 | 0 | 0.086 | 12 | 0.88 | 0.60 | 1.23 | 39.01 | 48.15 |
| 2 | | 0.75 | 0.36 | 16.81 | 16.06 | 16.44 | 0.54 | 0.54 | 0.188 | 0 | 0.086 | 10 | 0.88 | 0.84 | 0.96 | 42.74 | 41.18 |
| | 2 | 0.76 | 0.36 | 16.26 | 15.50 | 15.88 | 0.55 | 0.55 | 0.188 | 0 | 0.086 | 9 | 0.75 | 1.10 | 0.68 | 47.55 | 32.40 |
| 3 | | 0.76 | 0.36 | 15.70 | 14.94 | 15.32 | 0.55 | 0.55 | 0.188 | 0 | 0.086 | 11 | 0.88 | 0.58 | 1.31 | 35.41 | 46.46 |
| | 3 | 0.77 | 0.36 | 15.14 | 14.37 | 14.75 | 0.56 | 0.56 | 0.188 | 0 | 0.086 | 10 | 1 | 0.54 | 1.53 | 32.20 | 49.20 |
| 4 | | 0.77 | 0.36 | 14.57 | 13.80 | 14.19 | 0.56 | 0.56 | 0.188 | 0 | 0.086 | 9 | 0.88 | 0.77 | 1.06 | 36.67 | 38.97 |
| | 4 | 0.79 | 0.36 | 14.01 | 13.22 | 13.61 | 0.58 | 0.58 | 0.188 | 0 | 0.086 | 9 | 0.75 | 0.83 | 0.89 | 38.94 | 34.83 |
| 5 | | 0.83 | 0.36 | 13.43 | 12.60 | 13.02 | 0.57 | 0.57 | 0.188 | 0 | 0.086 | 5 | 1 | 1.73 | 0.60 | 41.78 | 25.20 |
| | 5 | 0.84 | 0.36 | 12.84 | 12.00 | 12.42 | 0.59 | 0.59 | 0.188 | 0 | 0.086 | 5 | 1 | 1.60 | 0.66 | 40.02 | 26.40 |
| 6 | | 0.84 | 0.36 | 12.24 | 11.40 | 11.82 | 0.58 | 0.58 | 0.188 | 0 | 0.086 | 3 | 1 | 3.12 | 0.35 | 43.75 | 15.48 |
| | 6 | 0.84 | 0.36 | 11.64 | 10.80 | 11.22 | 0.34 | 0.34 | 0.188 | 0 | 0.086 | 2 | 1 | 4.87 | 0.15 | 30.45 | 4.56 |
| 7 | | 0.84 | 0.36 | 11.04 | 10.20 | 10.62 | 0.34 | 0.34 | 0.188 | 0 | 0.086 | 2 | 1 | 4.56 | 0.16 | 28.60 | 4.56 |
| | | | | | | | | | | | | Sum | 100 | | | 493.20 | 423.12 |
| | | | | | | | | | | | | average | 7.69 | | | 37.94 | 72.38 |

Plot 4-1

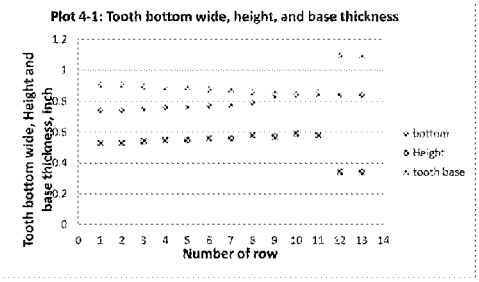

Plot 4-2

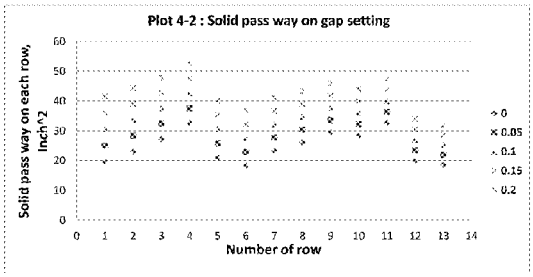

Plot 4-3

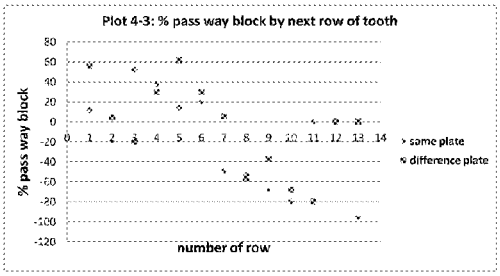

Plot 4-4

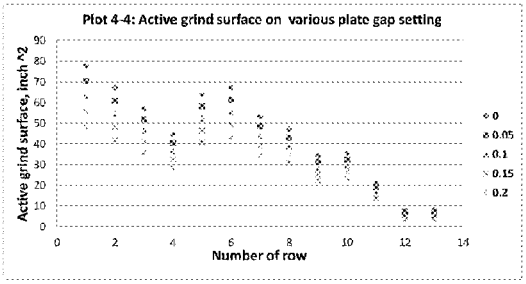

Fig. 18

The Summary of key design data for new improved grind plate design A

Improve design A with 0.8" tooth base wide, 0.65" tooth height, and 7 to 8 row of tooth for 36 single/double disc grind plate

| 0.09 | 0.521 | 6 | | Tooth on radius position, in | | | Height dimension | | Tooth profile, inch | | | Number | tooth length and spa | | | Solid open | Active grind |
|---|---|---|---|---|---|---|---|---|---|---|---|---|---|---|---|---|---|
| Number of row | | Zig Zip path | | tooth base | | | Valley | tooth | Tip | between two | | of tooth | Length | space | ratio | area at | surface area |
| | | bottom | top | out edge | inner | center | deep | height | wide | tip gap | side gap | per plate | L | D | D/L | 0.15" gap | at 0.15" gap |
| 1 | | 0.8 | 0.268 | 17.91 | 17.11 | 17.51 | 0.6488 | 0.64878 | 0.188 | 0 | 0.04 | 14 | 0.97 | 0.34 | 0.35 | 35.02 | 81.28 |
| | 1 | 0.8 | 0.268 | 17.38 | 16.58 | 16.98 | 0.6488 | 0.64878 | 0.188 | 0 | 0.04 | 14 | 0.9208 | 0.35 | 0.38 | 35.02 | 77.16 |
| 2 | | 0.8 | 0.268 | 16.84 | 16.04 | 16.44 | 0.6488 | 0.64878 | 0.188 | 0 | 0.04 | 14 | 0.8716 | 0.36 | 0.41 | 35.02 | 73.04 |
| | 2 | 0.8 | 0.268 | 16.31 | 15.51 | 15.91 | 0.6488 | 0.64878 | 0.188 | 0 | 0.04 | 14 | 0.8225 | 0.37 | 0.45 | 35.02 | 68.92 |
| 3 | | 0.8 | 0.268 | 15.77 | 14.97 | 15.37 | 0.6488 | 0.64878 | 0.188 | 0 | 0.04 | 14 | 0.7733 | 0.38 | 0.49 | 35.02 | 64.80 |
| | 3 | 0.8 | 0.268 | 15.24 | 14.44 | 14.84 | 0.6488 | 0.64878 | 0.188 | 0 | 0.04 | 14 | 0.7241 | 0.39 | 0.53 | 35.02 | 60.68 |
| 4 | | 0.8 | 0.268 | 14.71 | 13.91 | 14.31 | 0.6488 | 0.64878 | 0.188 | 0 | 0.04 | 14 | 0.6749 | 0.40 | 0.59 | 35.02 | 56.56 |
| | 4 | 0.8 | 0.268 | 14.17 | 13.37 | 13.77 | 0.6488 | 0.64878 | 0.188 | 0 | 0.04 | 14 | 0.6258 | 0.40 | 0.65 | 35.02 | 52.44 |
| 5 | | 0.8 | 0.268 | 13.64 | 12.84 | 13.24 | 0.6488 | 0.64878 | 0.188 | 0 | 0.04 | 14 | 0.5766 | 0.41 | 0.72 | 35.02 | 48.31 |
| | 5 | 0.8 | 0.268 | 13.10 | 12.30 | 12.70 | 0.6488 | 0.64878 | 0.188 | 0 | 0.04 | 14 | 0.5274 | 0.42 | 0.80 | 35.02 | 44.19 |
| 6 | | 0.8 | 0.268 | 12.57 | 11.77 | 12.17 | 0.6488 | 0.64878 | 0.188 | 0 | 0.04 | 12 | 0.5579 | 0.50 | 0.90 | 35.02 | 40.07 |
| | 6 | 0.8 | 0.268 | 12.04 | 11.24 | 11.64 | 0.6488 | 0.64878 | 0.188 | 0 | 0.04 | 12 | 0.5006 | 0.51 | 1.03 | 35.02 | 35.95 |
| 7 | | 0.8 | 0.268 | 11.50 | 10.70 | 11.10 | 0.6488 | 0.64878 | 0.188 | 0 | 0.04 | 10 | 0.5318 | 0.63 | 1.19 | 35.02 | 31.83 |
| | 7 | 0.8 | 0.268 | 10.97 | 10.17 | 10.57 | 0.6488 | 0.64878 | 0.188 | 0 | 0.04 | 10 | 0.463 | 0.64 | 1.39 | 35.02 | 27.71 |
| 8 | | 0.8 | 0.268 | 10.43 | 9.63 | 10.03 | 0.6488 | 0.64878 | 0.188 | 0 | 0.04 | 8 | 0.4926 | 0.82 | 1.67 | 35.02 | 23.59 |
| | | | | | | | | | | | Sum | 192 | | | | 525.27 | 786.53 |
| | | | | | | | | | | | average | 12.80 | | | | 35.02 | 52.44 |

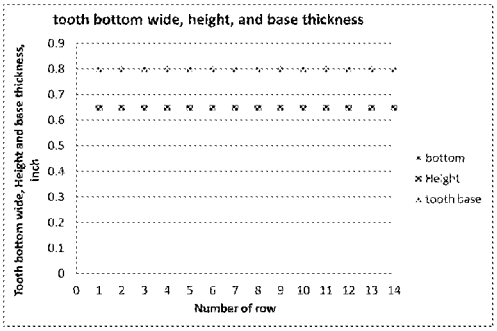

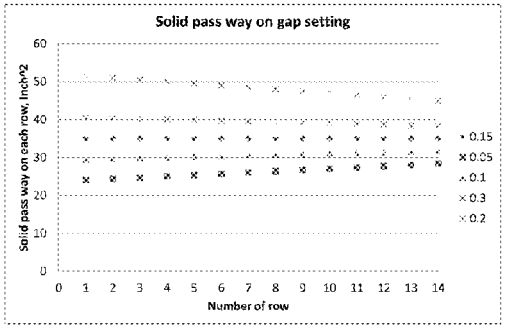

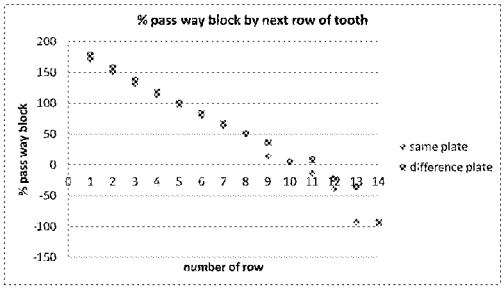

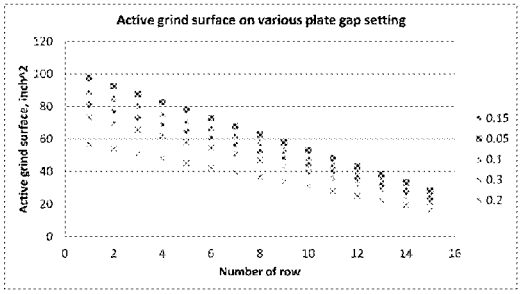

Fig. 19

The summary of key design data for new improved grind plate design B

Improve design B with 1.09" tooth base wide, 0.876" tooth height, 6 to 7 row tooth per plate. For 36 double disc and 52 single disc grind mill

| 0.086 | 0.521 | 6 | | Tooth on radius position, in | | | Height dimens | | Tooth profile, inch | | | Number | tooth length and space | | | Solid open | Active grind |
|---|---|---|---|---|---|---|---|---|---|---|---|---|---|---|---|---|---|
| Number of row | | Zig Zip path | | tooth base | | | Valley | tooth | Tip | between two | | of tooth | Length | space | ratio | area at | surface area |
| | | bottom | top | out edge | inner | center | deep | height | wide | tip gap | side gap | per plate | L | D | D/L | 0.15" gap | at 0.15" gap |
| 1 | | 1.09 | 0.268 | 17.91 | 16.82 | 17.37 | 0.874 | 0.874 | 0.188 | 0 | 0.04 | 14 | 1.045 | 0.25 | 0.24 | 35.02 | 127.19 |
| | 1 | 1.09 | 0.268 | 17.23 | 16.14 | 16.69 | 0.874 | 0.874 | 0.188 | 0 | 0.04 | 14 | 0.9855 | 0.26 | 0.27 | 35.02 | 119.94 |
| 2 | | 1.09 | 0.268 | 16.55 | 15.46 | 16.01 | 0.874 | 0.874 | 0.188 | 0 | 0.04 | 14 | 0.926 | 0.27 | 0.29 | 35.02 | 112.70 |
| | 2 | 1.09 | 0.268 | 15.87 | 14.78 | 15.33 | 0.874 | 0.874 | 0.188 | 0 | 0.04 | 14 | 0.8665 | 0.28 | 0.32 | 35.02 | 105.46 |
| 3 | | 1.09 | 0.268 | 15.19 | 14.10 | 14.65 | 0.874 | 0.874 | 0.188 | 0 | 0.04 | 14 | 0.807 | 0.29 | 0.36 | 35.02 | 98.22 |
| | 3 | 1.09 | 0.268 | 14.52 | 13.43 | 13.97 | 0.874 | 0.874 | 0.188 | 0 | 0.04 | 14 | 0.7475 | 0.30 | 0.40 | 35.02 | 90.98 |
| 4 | | 1.09 | 0.268 | 13.84 | 12.75 | 13.29 | 0.874 | 0.874 | 0.188 | 0 | 0.04 | 14 | 0.688 | 0.31 | 0.45 | 35.02 | 83.73 |
| | 4 | 1.09 | 0.268 | 13.16 | 12.07 | 12.61 | 0.874 | 0.874 | 0.188 | 0 | 0.04 | 14 | 0.6285 | 0.31 | 0.50 | 35.02 | 76.49 |
| 5 | | 1.09 | 0.268 | 12.48 | 11.39 | 11.93 | 0.874 | 0.874 | 0.188 | 0 | 0.04 | 12 | 0.6638 | 0.38 | 0.57 | 35.02 | 69.25 |
| | 5 | 1.09 | 0.268 | 11.80 | 10.71 | 11.25 | 0.874 | 0.874 | 0.188 | 0 | 0.04 | 12 | 0.5944 | 0.39 | 0.65 | 35.02 | 62.01 |
| 6 | | 1.09 | 0.268 | 11.12 | 10.03 | 10.58 | 0.874 | 0.874 | 0.188 | 0 | 0.04 | 10 | 0.63 | 0.48 | 0.76 | 35.02 | 54.77 |
| | 6 | 1.09 | 0.268 | 10.44 | 9.35 | 9.90 | 0.874 | 0.874 | 0.188 | 0 | 0.04 | 10 | 0.5467 | 0.49 | 0.90 | 35.02 | 47.52 |
| 7 | | 1.09 | 0.268 | 9.76 | 8.67 | 9.22 | 0.874 | 0.874 | 0.188 | 0 | 0.04 | 7 | 0.6619 | 0.72 | 1.08 | 35.02 | 40.28 |
| | | | | | | | | | | | Sum | 163 | | | | 455.23 | 1088.54 |
| | | | | | | | | | | | average | 12.54 | | | | 35.02 | 83.73 |

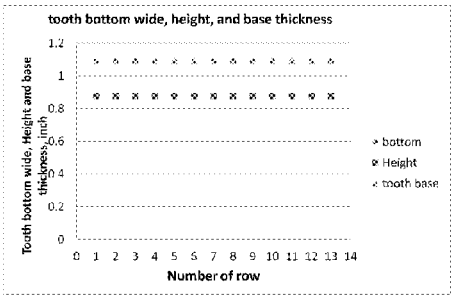

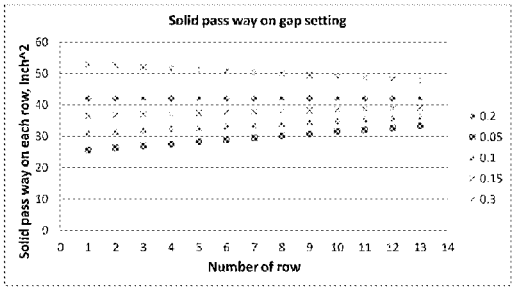

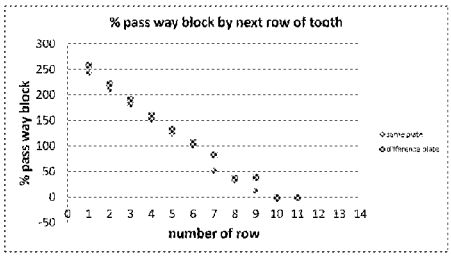

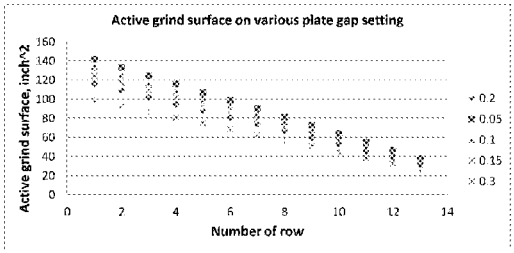

Fig. 20

Summary of key design data for new improved grind plate design C

Improve design C with 1.2" tooth base wide, 0.981" tooth height, and 5 to 6 row of tooth for 36 double disc and 52 inch single disc grind mill

| 0.09 | 0.521 | 6 | | Tooth on radius position, in | | | Height dimensi | | Tooth profile, inch | | | Number | tooth length and space | | | Solid oper | Active grind |
|---|---|---|---|---|---|---|---|---|---|---|---|---|---|---|---|---|---|
| Number of row | | Zig Zip path | | tooth base | | | Valley | tooth | Tip | between two | | of tooth | Length | space | ratio | area at | surface area |
| | | bottom | top | out edge | inner | center | deep | height | wide | tip gap | side gap | per plate | L | D | D/L | 0.15" gap | at 0.15" gap |
| 1 | | 1.2 | 0.27 | 17.91 | 16.71 | 17.31 | 0.981 | 0.981 | 0.188 | 0 | 0.04 | 14 | 1.0678 | 0.23 | 0.21 | 35.02 | 149.09 |
| | 1 | 1.2 | 0.27 | 17.18 | 15.98 | 16.58 | 0.981 | 0.981 | 0.188 | 0 | 0.04 | 14 | 1.0045 | 0.24 | 0.23 | 35.02 | 140.25 |
| 2 | | 1.2 | 0.27 | 16.44 | 15.24 | 15.84 | 0.981 | 0.981 | 0.188 | 0 | 0.04 | 14 | 0.9412 | 0.24 | 0.26 | 35.02 | 131.41 |
| | 2 | 1.2 | 0.27 | 15.71 | 14.51 | 15.11 | 0.981 | 0.981 | 0.188 | 0 | 0.04 | 14 | 0.8779 | 0.25 | 0.29 | 35.02 | 122.57 |
| 3 | | 1.2 | 0.27 | 14.97 | 13.77 | 14.37 | 0.981 | 0.981 | 0.188 | 0 | 0.04 | 14 | 0.8146 | 0.26 | 0.32 | 35.02 | 113.74 |
| | 3 | 1.2 | 0.27 | 14.24 | 13.04 | 13.64 | 0.981 | 0.981 | 0.188 | 0 | 0.04 | 14 | 0.7513 | 0.27 | 0.36 | 35.02 | 104.90 |
| 4 | | 1.2 | 0.27 | 13.51 | 12.31 | 12.91 | 0.981 | 0.981 | 0.188 | 0 | 0.04 | 14 | 0.688 | 0.28 | 0.40 | 35.02 | 96.06 |
| | 4 | 1.2 | 0.27 | 12.77 | 11.57 | 12.17 | 0.981 | 0.981 | 0.188 | 0 | 0.04 | 14 | 0.6247 | 0.29 | 0.46 | 35.02 | 87.22 |
| 5 | | 1.2 | 0.27 | 12.04 | 10.84 | 11.44 | 0.981 | 0.981 | 0.188 | 0 | 0.04 | 12 | 0.655 | 0.34 | 0.52 | 35.02 | 78.39 |
| | 5 | 1.2 | 0.27 | 11.30 | 10.10 | 10.70 | 0.981 | 0.981 | 0.188 | 0 | 0.04 | 12 | 0.5812 | 0.35 | 0.61 | 35.02 | 69.55 |
| 6 | | 1.2 | 0.27 | 10.57 | 9.37 | 9.97 | 0.981 | 0.981 | 0.188 | 0 | 0.04 | 10 | 0.6088 | 0.44 | 0.71 | 35.02 | 60.71 |
| | | | | | | | | | | | Sum | 146 | | | | 385.20 | 1153.89 |
| | | | | | | | | | | | average | 13.27 | | | | 35.02 | 104.90 |

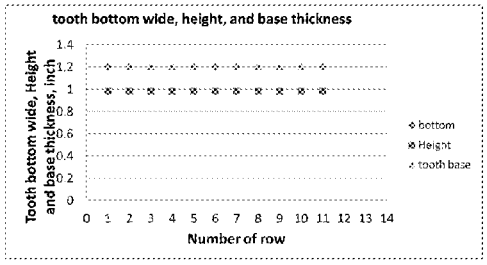

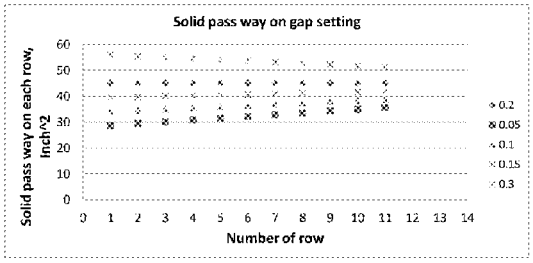

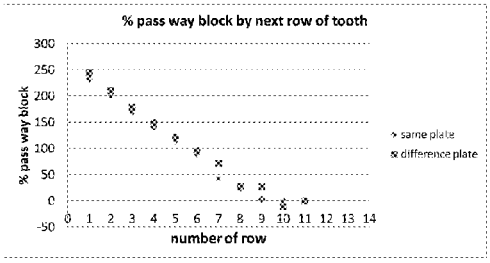

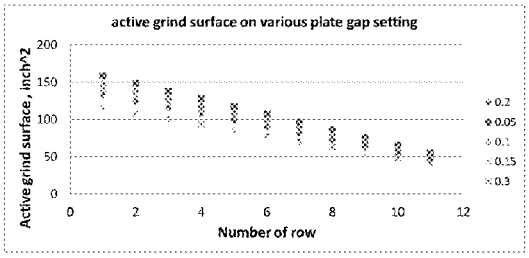

Fig. 21

New Grind Plate Design dimension sheet

| | | |
|---|---|---|
| Min gap | 0.04 | |
| side angle | 64.7360901 | |
| start bottom | 0.800 | |
| | 0.0006 | |
| | Tan(angle) | |
| | 0.41 | 1 |
| | 0.41 | 2 |
| | 0.41 | 3 |
| | 0.41 | 4 |
| | 0.41 | 5 |
| | 0.41 | 6 |
| | 0.41 | 7 |
| | 0.41 | 8 |
| | 0.41 | 9 |
| | 0.41 | 10 |
| | 0.41 | 11 |
| | 0.41 | 12 |
| | 0.41 | 13 |
| | 0.41 | 14 |
| | 0.41 | |

| 0.04 | 0.41 | 6 | | radius position, Inch | | | | |
|---|---|---|---|---|---|---|---|---|
| Number of row | | zip zag wide | | Tooth base | | Valley base | | Tooth |
| | | bottom | top | out edge | inner | out edge | inner | center |
| 1 | | 0.800 | 0.268 | 17.910 | 17.110 | 17.644 | 17.376 | 17.510 |
| | 1 | 0.800 | 0.268 | 17.376 | 16.576 | 17.110 | 16.842 | 16.976 |
| 2 | | 0.800 | 0.268 | 16.842 | 16.042 | 16.576 | 16.308 | 16.442 |
| | 2 | 0.800 | 0.268 | 16.308 | 15.508 | 16.042 | 15.774 | 15.908 |
| 3 | | 0.800 | 0.268 | 15.774 | 14.974 | 15.508 | 15.240 | 15.374 |
| | 3 | 0.800 | 0.268 | 15.240 | 14.440 | 14.974 | 14.706 | 14.840 |
| 4 | | 0.800 | 0.268 | 14.706 | 13.906 | 14.440 | 14.172 | 14.306 |
| | 4 | 0.800 | 0.268 | 14.172 | 13.372 | 13.906 | 13.638 | 13.772 |
| 5 | | 0.800 | 0.268 | 13.638 | 12.838 | 13.372 | 13.104 | 13.238 |
| | 5 | 0.800 | 0.268 | 13.104 | 12.304 | 12.838 | 12.570 | 12.704 |
| 6 | | 0.800 | 0.268 | 12.570 | 11.770 | 12.304 | 12.036 | 12.170 |
| | 6 | 0.800 | 0.268 | 12.036 | 11.236 | 11.770 | 11.502 | 11.636 |
| 7 | | 0.800 | 0.268 | 11.502 | 10.702 | 11.236 | 10.968 | 11.102 |
| | 7 | 0.800 | 0.268 | 10.968 | 10.168 | 10.702 | 10.434 | 10.568 |
| 8 | | 0.800 | 0.268 | 10.434 | 9.634 | 10.168 | 9.900 | 10.034 |
| Sun | | | | | | | | |

Fig. 22 view1

| | M | N | O | P | Q | R | S | T | U | V | W | X |
|---|---|---|---|---|---|---|---|---|---|---|---|---|
| 1 | | | | | | | | | | | | |
| 2 | | | | | | | | | | | | |
| 3 | | | | | | | | | | | | |
| 4 | | | | | | | | | | | | |
| 5 | Mountain | tooth | tooth tip | tooth | | Total space between two plate , inch | | | | | tooth design | |
| 6 | Height | Height | wide | tip gap | side gap | gap | gap | gap | gap | gap | Total length/sectior | |
| 7 | inch | inch | inch | inch | inch | 0 | 0.05 | 0.1 | 0.15 | 0.2 | Sum L | Sum D |
| 8 | 0.649 | 0.649 | 0.188 | 0.000 | 0.040 | 71.4 | 76.9 | 82.4 | 87.9 | 93.4 | 13.58 | 4.76 |
| 9 | 0.649 | 0.649 | 0.188 | 0.000 | 0.040 | 69.2 | 74.5 | 79.9 | 85.2 | 90.5 | 12.89 | 4.89 |
| 10 | 0.649 | 0.649 | 0.188 | 0.000 | 0.040 | 67.0 | 72.2 | 77.4 | 82.5 | 87.7 | 12.20 | 5.01 |
| 11 | 0.649 | 0.649 | 0.188 | 0.000 | 0.040 | 64.8 | 69.8 | 74.8 | 79.8 | 84.8 | 11.51 | 5.14 |
| 12 | 0.649 | 0.649 | 0.188 | 0.000 | 0.040 | 62.7 | 67.5 | 72.3 | 77.2 | 82.0 | 10.83 | 5.27 |
| 13 | 0.649 | 0.649 | 0.188 | 0.000 | 0.040 | 60.5 | 65.2 | 69.8 | 74.5 | 79.1 | 10.14 | 5.40 |
| 14 | 0.649 | 0.649 | 0.188 | 0.000 | 0.040 | 58.3 | 62.8 | 67.3 | 71.8 | 76.3 | 9.45 | 5.53 |
| 15 | 0.649 | 0.649 | 0.188 | 0.000 | 0.040 | 56.1 | 60.5 | 64.8 | 69.1 | 73.4 | 8.76 | 5.66 |
| 16 | 0.649 | 0.649 | 0.188 | 0.000 | 0.040 | 54.0 | 58.1 | 62.3 | 66.4 | 70.6 | 8.07 | 5.79 |
| 17 | 0.649 | 0.649 | 0.188 | 0.000 | 0.040 | 51.8 | 55.8 | 59.8 | 63.8 | 67.8 | 7.38 | 5.92 |
| 18 | 0.649 | 0.649 | 0.188 | 0.000 | 0.040 | 49.6 | 53.4 | 57.3 | 61.1 | 64.9 | 6.70 | 6.05 |
| 19 | 0.649 | 0.649 | 0.188 | 0.000 | 0.040 | 47.4 | 51.1 | 54.7 | 58.4 | 62.1 | 6.01 | 6.18 |
| 20 | 0.649 | 0.649 | 0.188 | 0.000 | 0.040 | 45.3 | 48.7 | 52.2 | 55.7 | 59.2 | 5.32 | 6.31 |
| 21 | 0.649 | 0.649 | 0.188 | 0.000 | 0.040 | 43.1 | 46.4 | 49.7 | 53.0 | 56.4 | 4.63 | 6.44 |
| 22 | 0.649 | 0.649 | 0.188 | 0.000 | 0.040 | 40.9 | 44.1 | 47.2 | 50.4 | 53.5 | 3.94 | 6.57 |
| 23 | | | | | | | | | | | 131.41 | 84.92 |
| 24 | | | | | | | | | | | | |
| 25 | | | | | | | | | | | | |
| 26 | | | | | | | | | | | | |

Fig. 22 view2

| | Y | Z | AA | AB | AC | AD | AE | AF | AG | AH | AI | AJ |
|---|---|---|---|---|---|---|---|---|---|---|---|---|
| 1 | | | | | | | | | | | | |
| 2 | | | | | | | | | | | | |
| 3 | | | | | | | | | | | | |
| 4 | | | 35 Solid pass way open area we want | | | | | | | | | |
| 5 | | Tooth length and space | | | | | | | Over lap grind surface inch^2 | | | |
| 6 | | D/L ratio | | | Solid pass way area , Inch^2 | | | | | at Various two plate gap | | |
| 7 | number | | L | D | 0.15 | 0.05 | 0.1 | 0.15 | 0.2 | 0.15 | 0.05 | 0.1 |
| 8 | 14 | 0.350 | 0.970 | 0.340 | 35.0 | 24.02 | 29.52 | 35.02 | 40.52 | 81.28 | 97.58 | 89.43 |
| 9 | 14 | 0.379 | 0.921 | 0.349 | 35.0 | 24.35 | 29.68 | 35.02 | 40.35 | 77.16 | 92.63 | 84.90 |
| 10 | 14 | 0.411 | 0.872 | 0.358 | 35.0 | 24.69 | 29.85 | 35.02 | 40.18 | 73.04 | 87.68 | 80.36 |
| 11 | 14 | 0.447 | 0.822 | 0.367 | 35.0 | 25.02 | 30.02 | 35.02 | 40.02 | 68.92 | 82.74 | 75.83 |
| 12 | 14 | 0.487 | 0.773 | 0.377 | 35.0 | 25.36 | 30.19 | 35.02 | 39.85 | 64.80 | 77.79 | 71.29 |
| 13 | 14 | 0.533 | 0.724 | 0.386 | 35.0 | 25.69 | 30.36 | 35.02 | 39.68 | 60.68 | 72.84 | 66.76 |
| 14 | 14 | 0.585 | 0.675 | 0.395 | 35.0 | 26.03 | 30.52 | 35.02 | 39.51 | 56.56 | 67.90 | 62.23 |
| 15 | 14 | 0.646 | 0.626 | 0.404 | 35.0 | 26.36 | 30.69 | 35.02 | 39.34 | 52.44 | 62.95 | 57.69 |
| 16 | 14 | 0.717 | 0.577 | 0.414 | 35.0 | 26.70 | 30.86 | 35.02 | 39.18 | 48.31 | 58.00 | 53.16 |
| 17 | 14 | 0.802 | 0.527 | 0.423 | 35.0 | 27.04 | 31.03 | 35.02 | 39.01 | 44.19 | 53.05 | 48.62 |
| 18 | 12 | 0.904 | 0.558 | 0.504 | 35.0 | 27.37 | 31.19 | 35.02 | 38.84 | 40.07 | 48.11 | 44.09 |
| 19 | 12 | 1.029 | 0.501 | 0.515 | 35.0 | 27.71 | 31.36 | 35.02 | 38.67 | 35.95 | 43.16 | 39.56 |
| 20 | 10 | 1.186 | 0.532 | 0.631 | 35.0 | 28.04 | 31.53 | 35.02 | 38.51 | 31.83 | 38.21 | 35.02 |
| 21 | 10 | 1.390 | 0.463 | 0.644 | 35.0 | 28.38 | 31.70 | 35.02 | 38.34 | 27.71 | 33.27 | 30.49 |
| 22 | 8 | 1.666 | 0.493 | 0.821 | 35.0 | 28.71 | 31.87 | 35.02 | 38.17 | 23.59 | 28.32 | 25.95 |
| 23 | 192.00 | 11.53 | 10.03 | 6.93 | 525.27 | 395.47 | 460.37 | 525.27 | 590.17 | 786.53 | 944.22 | 865.38 |
| 24 | | | | | | | | | | | | |
| 25 | | | | | | | | | | | | |
| 26 | | | | | | | | | | | | |

Fig. 22 view3

| | AK | AL | AM | AN | AO | AP | AQ | AR | AS | AT |
|---|---|---|---|---|---|---|---|---|---|---|
| 1 | | | | | | | | | | |
| 2 | | | | | | | | | | |
| 3 | | | | | | | | | | |
| 4 | | | | | | | | | | |
| 5 | | | | | | | 1.449 grind plate thickness, inch | | | |
| 6 | setting | | Grind surface, Inch^2 | | | Grind power | thickness | distance from center of two plate | | |
| 7 | 0.15 | 0.2 | front/ba | two side | total | power,Ft^3/sec | tooth base | No section | tip of mountain | valley |
| 8 | 81.28 | 73.13 | 58.20 | 105.73 | 163.93 | 313 | 0.800 | 6 | 0.324 | -0.324 |
| 9 | 77.16 | 69.43 | 58.20 | 100.37 | 158.57 | 293 | 0.800 | 6 | -0.324 | 0.324 |
| 10 | 73.04 | 65.72 | 58.20 | 95.01 | 153.21 | 275 | 0.800 | 6 | 0.324 | -0.324 |
| 11 | 68.92 | 62.01 | 58.20 | 89.65 | 147.85 | 256 | 0.800 | 6 | -0.324 | 0.324 |
| 12 | 64.80 | 58.30 | 58.20 | 84.29 | 142.49 | 239 | 0.800 | 6 | 0.324 | -0.324 |
| 13 | 60.68 | 54.59 | 58.20 | 78.93 | 137.13 | 222 | 0.800 | 6 | -0.324 | 0.324 |
| 14 | 56.56 | 50.89 | 58.20 | 73.56 | 131.77 | 206 | 0.800 | 6 | 0.324 | -0.324 |
| 15 | 52.44 | 47.18 | 58.20 | 68.20 | 126.41 | 190 | 0.800 | 6 | -0.324 | 0.324 |
| 16 | 48.31 | 43.47 | 58.20 | 62.84 | 121.05 | 175 | 0.800 | 6 | 0.324 | -0.324 |
| 17 | 44.19 | 39.76 | 58.20 | 57.48 | 115.69 | 160 | 0.800 | 6 | -0.324 | 0.324 |
| 18 | 40.07 | 36.06 | 49.89 | 52.12 | 102.01 | 135 | 0.800 | 6 | 0.324 | -0.324 |
| 19 | 35.95 | 32.35 | 49.89 | 46.76 | 96.65 | 123 | 0.800 | 6 | -0.324 | 0.324 |
| 20 | 31.83 | 28.64 | 41.57 | 41.40 | 82.98 | 100 | 0.800 | 6 | -0.324 | 0.324 |
| 21 | 27.71 | 24.93 | 41.57 | 36.04 | 77.62 | 89 | 0.800 | 6 | -0.324 | 0.324 |
| 22 | 23.59 | 21.22 | 33.26 | 30.68 | 63.94 | 70 | 0.800 | 6 | -0.324 | 0.324 |
| 23 | 786.53 | 707.69 | 798.22 | 1023.07 | 1821.29 | 2846.31 | | | | |
| 24 | | | | | | | | | | |
| 25 | | | | | | | | | | |
| 26 | | | | | | | | | | |

Fig. 22 view4

| | AU | AV | AW | AX |
|---|---|---|---|---|
| 1 | | | | |
| 2 | | | | |
| 3 | | | | |
| 4 | | | | |
| 5 | | | Tooth | |
| 6 | % block top row | | slop | |
| 7 | same plate | difference plate | angle | |
| 8 | 170.79 | 177.96 | 64.73609 | |
| 9 | 150.60 | 157.06 | 64.73609 | |
| 10 | 131.40 | 137.22 | 64.73609 | |
| 11 | 113.12 | 118.35 | 64.73609 | |
| 12 | 95.70 | 100.38 | 64.73609 | |
| 13 | 79.07 | 83.25 | 64.73609 | |
| 14 | 63.18 | 66.90 | 64.73609 | |
| 15 | 47.98 | 51.29 | 64.73609 | |
| 16 | 14.38 | 36.35 | 64.73609 | |
| 17 | 2.43 | 4.62 | 64.73609 | |
| 18 | -13.33 | 8.36 | 64.73609 | |
| 19 | -39.02 | -22.24 | 64.73609 | |
| 20 | -92.32 | -35.21 | 64.73609 | |
| 21 | | -93.32 | 64.73609 | |
| 22 | | | 64.73609 | |
| 23 | | | | |
| 24 | | | | |
| 25 | | | | |
| 26 | | | | |

Fig. 22 view5

Comparison between prior art design and new improved design, A,B and C

Summary of key data on current and new 52 inch grind plate design

A)Prior art lower ring grind plate 52 inch single disc grind mill

| 0.086 | 0.45 | 6 | | Tooth on radius position, inch | | | | | Tooth profile, inch | | | Number | Tooth base , inch | | | Solid open | Active grind |
|---|---|---|---|---|---|---|---|---|---|---|---|---|---|---|---|---|---|
| Number of row | | Zig Zip path | | tooth base | | | Vally de | tooth | Tip | tooth | | of tooth | tooth le | space be | ratio | area at | surface area |
| | | bottom | top | out edge | inner | center | | height | wide | tip gap | side gap | per plate | L | D | D/L | 0.15" gap | at 0.15" gap |
| 1 | | 0.74 | 0.36 | 17.91 | 17.17 | 17.54 | 0.53 | 0.53 | 0.188 | 0 | 0.086 | 13 | 0.875 | 0.54 | 0.61 | 60.81 | 24.57 |
| | 1 | 0.74 | 0.36 | 17.36 | 16.62 | 16.99 | 0.53 | 0.53 | 0.188 | 0 | 0.086 | 12 | 0.875 | 0.61 | 0.69 | 60.55 | 22.68 |
| 2 | | 0.75 | 0.36 | 16.81 | 16.06 | 16.44 | 0.54 | 0.54 | 0.188 | 0 | 0.086 | 10 | 0.875 | 0.85 | 0.97 | 63.56 | 19.95 |
| | 2 | 0.76 | 0.36 | 16.26 | 15.50 | 15.88 | 0.55 | 0.55 | 0.188 | 0 | 0.086 | 9 | 0.81 | 1.04 | 1.28 | 65.71 | 17.50 |
| 3 | | 0.76 | 0.36 | 15.70 | 14.94 | 15.32 | 0.55 | 0.55 | 0.188 | 0 | 0.086 | 11 | 0.875 | 0.58 | 0.67 | 54.84 | 23.10 |
| | 3 | 0.77 | 0.36 | 15.14 | 14.37 | 14.75 | 0.56 | 0.56 | 0.188 | 0 | 0.086 | 10 | 1 | 0.55 | 0.54 | 50.74 | 25.20 |
| 4 | | 0.77 | 0.36 | 14.57 | 13.80 | 14.19 | 0.56 | 0.56 | 0.188 | 0 | 0.086 | 9 | 0.875 | 0.78 | 0.89 | 54.65 | 19.85 |
| | 4 | 0.79 | 0.36 | 14.01 | 13.22 | 13.61 | 0.58 | 0.58 | 0.188 | 0 | 0.086 | 9 | 0.75 | 0.83 | 1.11 | 56.04 | 18.63 |
| 5 | | 0.83 | 0.36 | 13.43 | 12.60 | 13.02 | 0.57 | 0.57 | 0.188 | 0 | 0.086 | 5 | 0.875 | 1.85 | 2.12 | 60.27 | 11.55 |
| | 5 | 0.84 | 0.36 | 12.84 | 12.00 | 12.42 | 0.59 | 0.59 | 0.188 | 0 | 0.086 | 5 | 1 | 1.60 | 1.60 | 55.63 | 14.40 |
| 6 | | 0.84 | 0.36 | 12.24 | 11.40 | 11.82 | 0.58 | 0.58 | 0.188 | 0 | 0.086 | 3 | 0.875 | 3.25 | 3.71 | 59.90 | 7.25 |
| | 6 | 0.84 | 0.36 | 11.64 | 10.80 | 11.22 | 0.34 | 0.34 | 0.188 | 0 | 0.086 | 2 | 1 | 4.87 | 4.87 | 44.54 | -0.24 |
| 7 | | 0.84 | 0.36 | 11.04 | 10.20 | 10.62 | 0.34 | 0.34 | 0.188 | 0 | 0.086 | 2 | 0.875 | 4.68 | 5.35 | 42.45 | -0.21 |
| | | | | | | | | | | | | | | | Sum | 729.68 | 204.22 |
| | | | | | | | | | | | | | | | Averge | 56.13 | 15.71 |

B)Prior art Upper ring grind plate 52 inch single disc grind mill

| 0.086 | 0.45 | 12 | | Tooth on radius position, inch | | | | | Tooth profile, inch | | | Number | Tooth base , inch | | | Solid open | Active grind |
|---|---|---|---|---|---|---|---|---|---|---|---|---|---|---|---|---|---|
| Number of row | | Zig Zip path | | tooth base | | | Vally de tooth | | Tip | tooth | | of tooth | tooth le space be | | ratio | area at | surface area |
| | | bottom | top | out edge | inner | center | | height | wide | tip gap | side gap | per plate | L | D | D/L | 0.15" gap | at 0.15" gap |
| 1 | | 0.61 | 0.19 | 26 | 25.39 | 25.695 | 0.42 | 0.42 | 0.018 | 0 | 0.086 | 10 | 0.938 | 1.753 | 1.87 | 100.69 | 7.88 |
| | 1 | 0.615 | 0.19 | 25.6 | 24.99 | 25.293 | 0.425 | 0.425 | 0.018 | 0 | 0.086 | 8 | 0.875 | 2.436 | 2.78 | 105.31 | 6.30 |
| 2 | | 0.62 | 0.19 | 25.1975 | 24.58 | 24.888 | 0.43 | 0.43 | 0.018 | 0 | 0.086 | 7 | 0.875 | 2.848 | 3.26 | 106.17 | 5.88 |
| | 2 | 0.625 | 0.19 | 24.7925 | 24.17 | 24.48 | 0.435 | 0.435 | 0.018 | 0 | 0.086 | 9 | 0.902 | 1.947 | 2.16 | 99.56 | 8.28 |
| 3 | | 0.63 | 0.19 | 24.385 | 23.76 | 24.07 | 0.44 | 0.44 | 0.018 | 0 | 0.086 | 8 | 0.875 | 2.276 | 2.60 | 101.00 | 7.56 |
| | 3 | 0.635 | 0.19 | 23.975 | 23.34 | 23.658 | 0.445 | 0.445 | 0.018 | 0 | 0.086 | 8 | 0.875 | 2.222 | 2.54 | 99.48 | 7.98 |
| 4 | | 0.64 | 0.19 | 23.5625 | 22.92 | 23.243 | 0.45 | 0.45 | 0.018 | 0 | 0.086 | 7 | 0.875 | 2.602 | 2.97 | 100.29 | 7.35 |
| | 4 | 0.645 | 0.19 | 23.1475 | 22.5 | 22.825 | 0.455 | 0.455 | 0.018 | 0 | 0.086 | 7 | 0.875 | 2.54 | 2.90 | 98.73 | 7.72 |
| 5 | | 0.65 | 0.19 | 22.73 | 22.08 | 22.405 | 0.46 | 0.46 | 0.018 | 0 | 0.086 | 7 | 0.75 | 2.602 | 3.47 | 99.54 | 6.93 |
| | 5 | 0.655 | 0.19 | 22.31 | 21.66 | 21.983 | 0.465 | 0.465 | 0.018 | 0 | 0.086 | 7 | 0.875 | 2.414 | 2.76 | 95.48 | 8.45 |
| 6 | | 0.66 | 0.19 | 21.8875 | 21.23 | 21.558 | 0.47 | 0.47 | 0.018 | 0 | 0.086 | 5 | 1 | 3.515 | 3.51 | 96.97 | 7.20 |
| | 6 | 0.665 | 0.19 | 21.4625 | 20.8 | 21.13 | 0.475 | 0.475 | 0.018 | 0 | 0.086 | 4 | 1.313 | 4.219 | 3.21 | 94.57 | 7.88 |
| 7 | | 0.67 | 0.19 | 21.035 | 20.37 | 20.7 | 0.48 | 0.48 | 0.018 | 0 | 0.086 | 4 | 1 | 4.419 | 4.42 | 96.43 | 6.24 |
| | | | | | | | | | | | | | | | Sum | 1294.21 | 95.64 |
| | | | | | | | | | | | | | | | Averge | 99.55 | 7.36 |
| | | | | | | | | | | | | | | | Total current | 2023.89 | 299.85 |

Fig. 24

C) New 52 inch single disc lower ring grind plate

| 0.04 | 0.45 | 6 | | Tooth on radius position, i | | | Height dimensior | | Tooth profile, inch | | | Number | tooth length and space | | | Solid open | Active grind |
|---|---|---|---|---|---|---|---|---|---|---|---|---|---|---|---|---|---|
| Number of row | | Zig Zip path | | tooth base | | | Valley | tooth | Tip | between two | | of tooth | Length | space | ratio | area at | surface area |
| | | bottom | top | out edge | inner | center | deep | height | wide | tip gap | side gap | per plate | L | D | D/L | 0.35" gap | at 0.35" gap |
| 1 | | 1.09 | 0.268 | 17.91 | 16.82 | 17.365 | 0.874 | 0.874 | 0.188 | 0 | 0.04 | 14 | 0.841 | 0.458 | 0.55 | 77.04 | 37.81 |
| | 1 | 1.09 | 0.268 | 17.231 | 16.14 | 16.686 | 0.874 | 0.874 | 0.188 | 0 | 0.04 | 14 | 0.781 | 0.467 | 0.60 | 77.04 | 35.13 |
| 2 | | 1.09 | 0.268 | 16.552 | 15.46 | 16.007 | 0.874 | 0.874 | 0.188 | 0 | 0.04 | 14 | 0.722 | 0.476 | 0.66 | 77.04 | 32.45 |
| | 2 | 1.09 | 0.268 | 15.873 | 14.78 | 15.328 | 0.874 | 0.874 | 0.188 | 0 | 0.04 | 14 | 0.662 | 0.484 | 0.73 | 77.04 | 29.77 |
| 3 | | 1.09 | 0.268 | 15.194 | 14.1 | 14.649 | 0.874 | 0.874 | 0.188 | 0 | 0.04 | 14 | 0.603 | 0.493 | 0.82 | 77.04 | 27.09 |
| | 3 | 1.09 | 0.268 | 14.515 | 13.43 | 13.97 | 0.874 | 0.874 | 0.188 | 0 | 0.04 | 14 | 0.543 | 0.502 | 0.92 | 77.04 | 24.41 |
| 4 | | 1.09 | 0.268 | 13.836 | 12.75 | 13.291 | 0.874 | 0.874 | 0.188 | 0 | 0.04 | 14 | 0.484 | 0.51 | 1.06 | 77.04 | 21.72 |
| | 4 | 1.09 | 0.268 | 13.157 | 12.07 | 12.612 | 0.874 | 0.874 | 0.188 | 0 | 0.04 | 14 | 0.424 | 0.519 | 1.22 | 77.04 | 19.04 |
| 5 | | 1.09 | 0.268 | 12.478 | 11.39 | 11.933 | 0.874 | 0.874 | 0.188 | 0 | 0.04 | 14 | 0.365 | 0.528 | 1.45 | 77.04 | 16.36 |
| | 5 | 1.09 | 0.268 | 11.799 | 10.71 | 11.254 | 0.874 | 0.874 | 0.188 | 0 | 0.04 | 12 | 0.356 | 0.626 | 1.76 | 77.04 | 13.68 |
| 6 | | 1.09 | 0.268 | 11.12 | 10.03 | 10.575 | 0.874 | 0.874 | 0.188 | 0 | 0.04 | 10 | 0.344 | 0.763 | 2.22 | 77.04 | 11.00 |
| | 6 | 1.09 | 0.268 | 10.441 | 9.351 | 9.896 | 0.874 | 0.874 | 0.188 | 0 | 0.04 | 10 | 0.261 | 0.776 | 2.98 | 77.04 | 8.32 |
| | | | | | | | | | | | | | | Sum | | 924.47 | 276.78 |
| | | | | | | | | | | | | | | Averge | | 77.04 | 23.06 |

D) New 52 inch single disc upper ring grind plate

| 0.04 | 0.45 | 12 | | Tooth on radius position, i | | | Height dimensior | | Tooth profile, inch | | | Number | tooth length and space | | | Solid open | Active grind |
|---|---|---|---|---|---|---|---|---|---|---|---|---|---|---|---|---|---|
| Number of row | | Zig Zip path | | tooth base | | | Valley | tooth | Tip | between two | | of tooth | Length | space | ratio | area at | surface area |
| | | bottom | top | out edge | inner | center | deep | height | wide | tip gap | side gap | per plate | L | D | D/L | 0.15" gap | at 0.15" gap |
| 1 | | 0.82 | 0.268 | 26 | 25.18 | 25.59 | 0.613 | 0.613 | 0.188 | 0 | 0.04 | 10 | 0.988 | 0.352 | 0.36 | 77.04 | 66.85 |
| | 1 | 0.82 | 0.268 | 25.456 | 24.64 | 25.046 | 0.613 | 0.613 | 0.188 | 0 | 0.04 | 10 | 0.952 | 0.359 | 0.38 | 77.04 | 64.02 |
| 2 | | 0.82 | 0.268 | 24.912 | 24.09 | 24.502 | 0.613 | 0.613 | 0.188 | 0 | 0.04 | 10 | 0.917 | 0.366 | 0.40 | 77.04 | 61.20 |
| | 2 | 0.82 | 0.268 | 24.368 | 23.55 | 23.958 | 0.613 | 0.613 | 0.188 | 0 | 0.04 | 10 | 0.882 | 0.373 | 0.42 | 77.04 | 58.37 |
| 3 | | 0.82 | 0.268 | 23.824 | 23 | 23.414 | 0.613 | 0.613 | 0.188 | 0 | 0.04 | 10 | 0.846 | 0.38 | 0.45 | 77.04 | 55.54 |
| | 3 | 0.82 | 0.268 | 23.28 | 22.46 | 22.87 | 0.613 | 0.613 | 0.188 | 0 | 0.04 | 10 | 0.811 | 0.387 | 0.48 | 77.04 | 52.71 |
| 4 | | 0.82 | 0.268 | 22.736 | 21.92 | 22.326 | 0.613 | 0.613 | 0.188 | 0 | 0.04 | 10 | 0.775 | 0.394 | 0.51 | 77.04 | 49.89 |
| | 4 | 0.82 | 0.268 | 22.192 | 21.37 | 21.782 | 0.613 | 0.613 | 0.188 | 0 | 0.04 | 10 | 0.74 | 0.401 | 0.54 | 77.04 | 47.06 |
| 5 | | 0.82 | 0.268 | 21.648 | 20.83 | 21.238 | 0.613 | 0.613 | 0.188 | 0 | 0.04 | 10 | 0.704 | 0.408 | 0.58 | 77.04 | 44.23 |
| | 5 | 0.82 | 0.268 | 21.104 | 20.28 | 20.694 | 0.613 | 0.613 | 0.188 | 0 | 0.04 | 10 | 0.669 | 0.415 | 0.62 | 77.04 | 41.40 |
| 6 | | 0.82 | 0.268 | 20.56 | 19.74 | 20.15 | 0.613 | 0.613 | 0.188 | 0 | 0.04 | 10 | 0.633 | 0.422 | 0.67 | 77.04 | 38.58 |
| | 6 | 0.82 | 0.268 | 20.016 | 19.2 | 19.606 | 0.613 | 0.613 | 0.188 | 0 | 0.04 | 10 | 0.598 | 0.429 | 0.72 | 77.04 | 35.75 |
| 7 | | 0.82 | 0.268 | 19.472 | 18.65 | 19.062 | 0.613 | 0.613 | 0.188 | 0 | 0.04 | 10 | 0.562 | 0.436 | 0.78 | 77.04 | 32.92 |
| | | | | | | | | | | | | | | | Sum | 1001.51 | 648.53 |
| | | | | | | | | | | | | | | | Averge | 77.04 | 49.89 |
| | | | | | | | | | | | | Total new design plate | | | | 1925.98 | 925.31 |

Fig. 24 (continued)

52 inch grind plate comparison plot
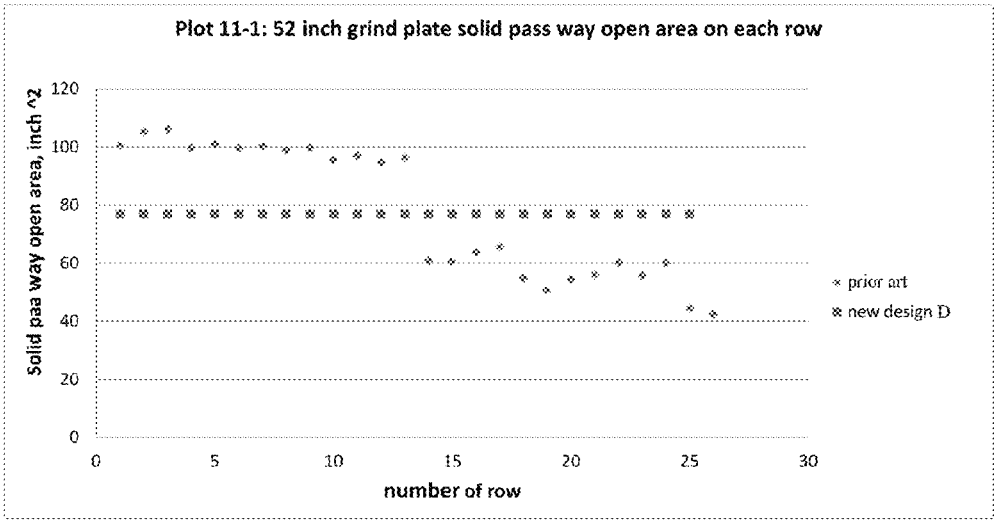
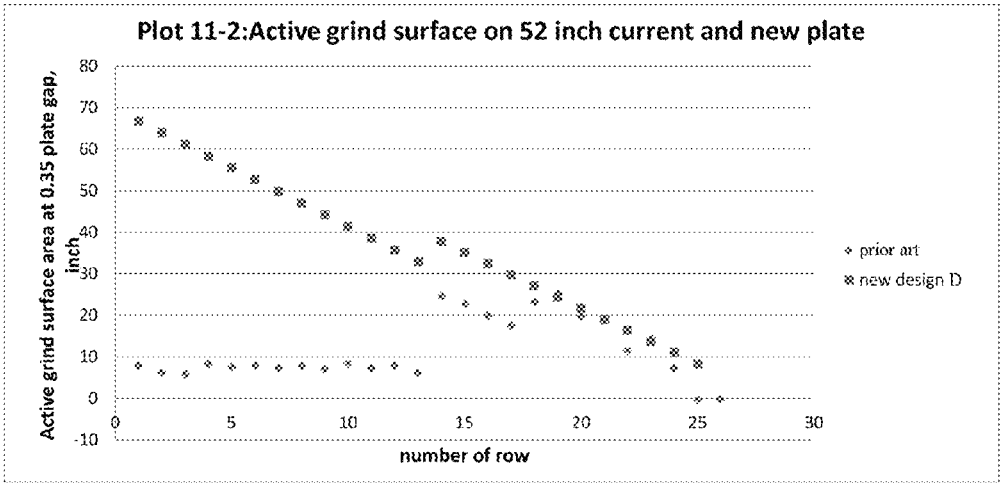
Fig. 25 solid pass way open area comparsion plot
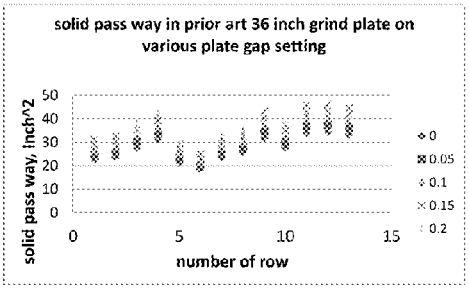
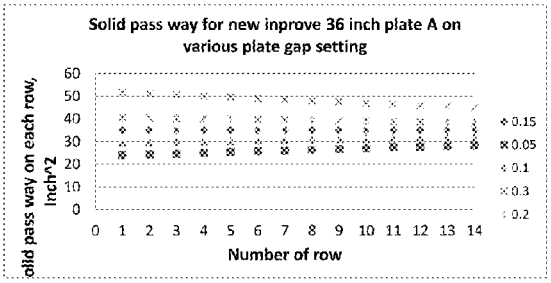
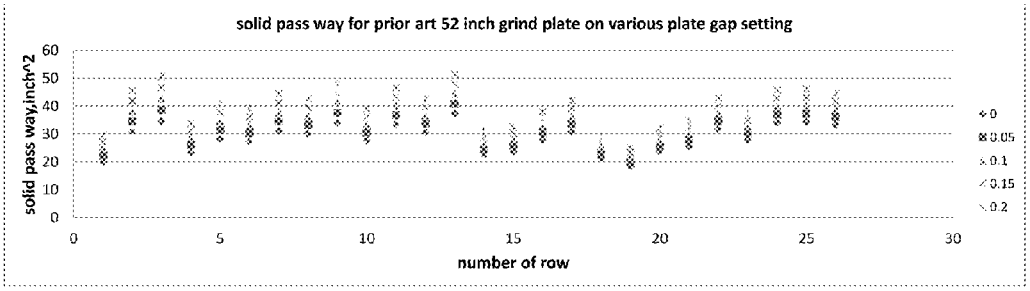
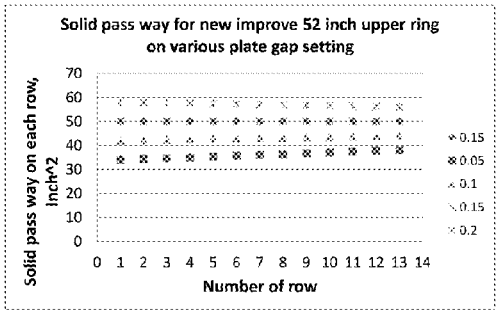
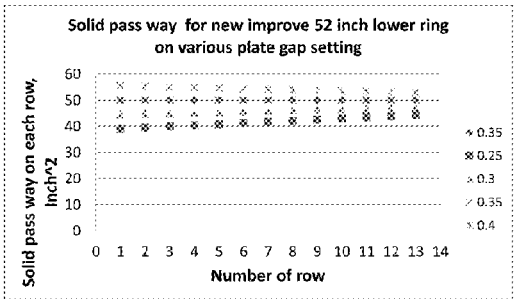
Fig. 26

GRIND MILL FOR DRY MILL INDUSTRY

RELATED APPLICATIONS

This patent application claims priority under 35 U.S.C. 119 (e) of the U.S. Provisional Application Ser. No. 61/717,431, filed Oct. 23, 2012, and entitled "Grind Mill For Dry Mill Industry". This application incorporates U.S. Provisional Application Ser. No. 61/717,431 in its entirety by reference.

FIELD OF THE INVENTION

The present invention is generally directed to the field of grind mills. More specifically, the present invention is directed to grind mills for the dry mill industry.

BACKGROUND OF THE INVENTION

A grind mill is a type of device for decreasing particle size of an input solid material, which has been widely used in a variety of industries such as the chemical and food industries. There are many types of grind mills including, but not limited to, a pin mill, a ball mill, a colloid mill, a conical mill, a disintegrator, a disk mill, an edge mill, and a hammer mill. The disc mill has two grind plates which rotate at different speeds. Solid particles pass through a gap between the two plates to decrease the particle size by grind plate action. If one grind plate is stationary and the other grind plate rotates, this is referred to as a single-disc mill. If both grind plates rotate but in opposite directions, it is referred to as a double-disc mill.

Typical applications for a single-disc mill are for wet milling processes such as in corn wet milling and the paper industry, manufacture of peanut butter, processing nut shells, ammonium nitrate, urea, producing chemical slurries and recycled paper slurries, and grinding chromium metal. Double-disc mills are typically used in the paper industry and as well other industry such as alloy powders, aluminum chips, bark, barley, borax, brake lining scrap, brass chips, sodium hydroxide, chemical salts, coconut shells, copper powder, cork, cottonseed hulls, pharmaceuticals, feathers, hops, leather, oilseed cakes, phosphates, rice, rosin, sawdust, and seeds.

In an exemplary application in the dry mill industry, corn is passed though a hammer mill to grind the corn to flour with wide particle size distribution, such as smaller than 45 micron to 3 mm size. Water is then added to liquefy the starch and convert to a sugar solution before sending to a fermenter to convert the sugar to alcohol. Some germ and grit particles with size larger than 200 micron need further grinding in the liquefaction step to further break up the solid particles to break the bond between starch/protein/oil/fiber in the germ and grit particles. Examples of such a a process can be found in patent application Ser. No. 13/428,263, entitled "Dry Grind Ethanol Production Process and System with Front End Milling Method", which is hereby incorporated in its entirety by reference.

Two types of grind plates are the devil tooth design and the bar and groove design. FIG. 1 illustrates to down view of a grind surface of a conventional bar and groove grind plate design. FIG. 2 illustrates a top down view of a grind surface of a conventional devil tooth design. Both the bar and groove grind plate and the devil grind plate span 60 degrees, six such plate are positioned end to end to form a completed grind disc spanning 360 degrees. The grind discs are typically 36 inches or 52 inches in diameter. The exemplary bar and groove disc plate shown in FIG. 1 and the devil grind plate shown in FIG. 2 are for a 36 inch diameter grind disc. A 52 inch diameter grind disc can be formed using a single ring of six such grind plates, as described above, or alternatively using two separate rings. The first ring is formed using similar grind plates as those used to form the single ring, 36 inch diameter grind disc, and the second ring is formed around the first ring using twelve similar grind plates as the inner ring except each of the twelve outer ring grind plates spans 30 degrees. The inner edge of the outer ring grind plates are configured to mate to the outer edge of the inner ring grind plates. The bar and groove grind plates are normally used in the paper industry. The devil tooth grind plates are normally used in the corn mill industry and prove better than bar and groove grind plates in this application because devil tooth grind plates result in higher capacity and avoid producing too much fine fiber, as is the case with bar and groove grind plates.

The disc mill has two grind plates fitted together such that the grinding elements, for example the teeth of the devil tooth grind plate design, face each other. FIG. 3A illustrates a top down view of a grind plate A of a conventional devil tooth design used in the dry mill industry. FIG. 3B illustrates a side view of the grind plate A of FIG. 3A. The grind plate A is the first of two complementary grind plates used in a disc mill. FIG. 4A illustrates a top down view of a grind plate B of a conventional devil tooth design used in the dry mill industry. FIG. 4B illustrates a side view of the grind plate B of FIG. 4A. The grind plate B is the second plate of the disc mill and is the complement to grind plate A. The grinding surface of grind plate A shown in FIG. 3A faces the grinding surface of grind plate B shown in FIG. 4A such that row 1 of grind plate A is positioned between rows 1 and 2 of grind plate B, row 2 of grind plate A is positioned between rows 2 and 3 of grind plate B, and so on. The grind plates A and B are spaced by a gap to provide a solid path way through which the material to be ground can pass. The actual grind surface of the devil tooth grind plate design is considered the tooth side surface. The actual grind surface on a bar and groove grind plate design is considered the total bar surface. Comparing the actual grind surfaces of the two designs, the bar and groove grind plate design has an actual grind surface of around 350 square inches as compare with the devil tooth grind plate design that has an actual grind surface of around 570 square inches. The grind plate efficiency depends on the actual grind surface multiplied by the rotating tip speed of teeth. The grind capacity depends on a solid pass way open area with minimum gap between the teeth on opposite sides of the complementary grind plates.

FIG. 5A illustrates detailed design parameter values corresponding to the devil tooth grind plate design. The tooth variable L is the tooth length, the tooth variable W is the tooth width, the tooth variable H is the tooth height, the tooth variable A is the tooth front and back slope angle, and the tooth variable B is the tooth side slope angle. The grind plate variable N is the number of teeth on each row, the grind plate variable D is the distance between teeth on the same row, and the grind plate variable R is the number of rows on the grind plate. The conventional devil tooth grind plate is designed with teeth in adjacent rows substantially aligned or primarily aligned so that an open channel is formed, such as the straight channel view shown in FIG. 5B. FIG. 5C illustrates a cut out side view of the of the two complementary grind plates with the two grind plates touching. A plate gap P is defined as the distance between the tip of the teeth on one grind plate, such as grind plate A, and the surface of the other grind plate, such as grind plate B, opposite the tip of the teeth. A side gap G is the separation distance between the side surfaces of opposing teeth on the two grind plates.

The conventional devil tooth grind plate design has a number of disadvantages. First, the number of teeth on the inner rows, the rows closest to the center of the grind disc, decreases significantly compared to the number of teeth on the outer rows because there is a need for more open area for solid pass through. The fewer the number of teeth the lower the grinding capacity. Second, the tooth height H is too short, from 0.34 to 0.59 inches in conventional designs, and the tooth height H-to-tooth width W ratio is too low, from 0.4 to 0.7 for conventional designs. For high feed rate, the side gap G separating opposing tooth side surfaces are farther apart to give enough opening area for solid pass though. The greater the gap G, the less the overlapping grind surface from opposing tooth side surfaces. Third, the solid pass way open area on each row is not constant and results in braking action of the solid passing from the inner rows to the outer rows. This also results in additional power requirements. Fourth, the straight channel configuration of teeth from row to row does not block solid material from easily bypassing multiple rows without being ground. Fifth, the feed inlet design is not uniform and consistent, which leads to irregular input of solid material into the disc mill.

SUMMARY OF THE INVENTION

Embodiments are directed to an improved disc mill design. The disc mill includes an inlet configured to provide solid material for grinding to the grind plates in a smooth and constant manner. A solid ring is added around an outer circumference of the grind plates to control the grinded solid discharge rate. In some embodiments, the grind plates are configured with constant solid path way open area from row to row. In some embodiments, the grind surface and solid pass way open area are maximized by increasing the relative tooth height compared to the tooth width. In some embodiments, the teeth are positioned according to a block channel configurations so as to force the solid material to pass along the grind surface of each row. A grind plate design program is used to enable conjunction of the design parameters with application variation, thereby enabling the optimum grind plate design to meeting various applications needed.

In an aspect, a grind plate of a grind mill is disclosed. The grind plate includes a base plate having a first surface, and a plurality of teeth aligned in a plurality of rows. Each tooth extends from the first surface of the base plate. Each tooth has a tooth base width W along a radial axis of the grind plate and a tooth height H, and each tooth has a tooth height H-to-tooth base width W ratio in the range of 0.8 to 1. In some embodiments, each row has a solid path way open area through which a solid material passes, wherein a value of the solid path way open area is the same from row to row. In some embodiments, the solid path way open area for a specific row is an arc distance through a center of all the teeth in the specific row multiplied by the tooth height H minus a cross-sectional area of all the teeth in the specific row. In some embodiments, the teeth in a specific row are separated by a tooth separation distance D and each tooth has a tooth base length L along a direction of the specific row, and a ratio of the tooth separation distance D-to-the tooth base length L is in the range of 0.2 to 2. In this case, the ratio of the tooth separation distance D-to-the tooth base length L is no greater than 2. In some embodiments, the teeth in each row are positioned according to a block channel configuration. In some embodiments, a number of teeth in each row is selected so that the tooth base length L is in the range of 0.4 to 1.6 inch. In some embodiments, each tooth has a tooth base length L along a direction of the row, and a number of teeth in each row is selected so that the ratio of the tooth base length L-to-the tooth base width W is in the range of 0.4 to 1.2.

In another aspect, a grind mill for grinding a solid material is disclosed. The dry mill includes a plurality of first grind plates and a plurality of second grind plates. Each first grind plate has a plurality of teeth aligned in a plurality of first rows. The plurality of first grind plates are coupled as a first grind disc. Each second grind plate has a plurality of teeth aligned in a plurality of second rows. The plurality of second grind plates are coupled as a second grind disc. The first grind disc and the second grind disc face each other to form alternating first and second rows of teeth having adjacent side surfaces separated by a side gap. Each tooth has a tooth base width W along a radial axis of the grind discs and a tooth height H, and each tooth has a tooth height H-to-tooth base width W ratio in the range of 0.8 to 1.

In some embodiments, the grind mill is configured for a dry milling process. In some embodiments, each first row and each second row has a solid path way open area through which the solid material passes, wherein a value of the solid path way open area is the same for all first and second rows. In some embodiments, the constant solid path way open area enables a constant capacity of solid material to be moved between the grind discs from a center of the grind discs to an outer perimeter of the grind discs thereby grinding the solid material. In some embodiments, the solid path way open area for a specific row is a circumference through a center of all the teeth in the specific row multiplied by a tooth height H minus a cross-sectional area of all the teeth in the specific row. In some embodiments, the teeth in a specific row are separated by a tooth separation distance D and each tooth has a tooth base length L along a direction of the specific row, wherein the value of the solid path way open area for the specific row is formed by adjusting a number of teeth for the specific row and a ratio of the tooth separation distance D-to-the tooth base length L for the specific row. In some embodiments, a ratio of the tooth separation distance D-to-the tooth base length L is different for each row. In some embodiments, a ratio of the tooth separation distance D-to-the tooth base length L is in the range of 0.2 to 2. In this case, the ratio of the tooth separation distance D-to-the tooth base length L is no greater than 2. In some embodiments, the teeth in the plurality of first rows and the teeth in the plurality of second rows are positioned according to a block channel configuration. In some embodiments, a number of teeth in the specific row is selected so that the tooth base length L is in the range of 0.4 to 1.6 inch. In some embodiments, and a number of teeth in the specific row is selected so that the ratio of the tooth base length L-to-the tooth base width W is in the range of 0.4 to 1.2. In some embodiments, a ratio of the tooth separation distance D-to-the tooth base length L increases from first and second rows having a larger radial distance to first and second rows having a smaller radial distance.

In some embodiments, the grind mill also includes a solid material inlet coupled to a center of the first and second grind discs. In some embodiments, the grind mill also includes a solid material acceleration vane coupled to the center of the first and second grind plates and to the solid material inlet, wherein the solid material acceleration vane is configured to direct the solid material from the solid material inlet to the first and second grind discs. In some embodiments, the grind mill also includes a solid material holding tank coupled to the solid material inlet, wherein the solid material holding tank is configured to self-adjust a feed rate of the solid material to the first and second grind discs. In some embodiments, self-adjusting the feed rate functions to maintain a maximum motor amperage of a motor driving the grind discs. In some embodiments, the grind mill also includes an adjustment ring coupled to an outer perimeter of the first and second grind discs, wherein the adjustment ring is configured to adjust a plate gap P between the first grind disc and the second grind disc to control a solid material discharge rate and to enable a specified solid material load. In some embodiments, the first and second grind discs are 36 inch diameter grind discs. In some embodiments, the first grind disc and the second grind disc each have a two ring configuration, wherein a first ring comprises a plurality of inner-ring grind plates and a second ring comprises a plurality of outer-ring grind plates positioned around the plurality of inner-ring grind plates. In some embodiments, a tooth height H of the teeth in the first ring is different than a tooth height H of the teeth in the second ring. In some embodiments, a plate gap P between the inner ring of the first grind disc and the inner ring of the second grind disc is different than a plate gap P between the outer ring of the first grind disc and the outer ring of the second grind disc. In some embodiments, the first and second grind plates are tilt mounted relative to each other.

In yet another aspect, a process for grinding a solid material is disclosed. The process includes inputting the solid material to a center of a grind mill having a complementary pair of grind discs. The process also includes moving the solid material between the grind discs at a constant capacity from a center of the grind discs to an outer perimeter of the grind discs thereby grinding the solid material. Each grind disc has a plurality of teeth aligned in a plurality of rows. Each tooth has a tooth base width W along a radial axis of the grind discs and a tooth height H, and each tooth has a tooth height H-to-tooth base width W ratio in the range of 0.8 to 1. The process also includes discharging ground material from the grind discs. In some embodiments, each row has a solid path way open area through which the solid material passes, wherein a value of the solid path way open area is the same from row to row.

BRIEF DESCRIPTION OF THE DRAWINGS

Several example embodiments are described with reference to the drawings, wherein like components are provided with like reference numerals. The example embodiments are intended to illustrate, but not to limit, the invention. The drawings include the following figures:

FIG. 18 illustrates design parameter values corresponding to an exemplary prior art grind plate design.

FIG. 19 illustrates a summary of design parameter values corresponding to an exemplary first complementary grind plate pair, referred to as design A.

FIG. 20 illustrates a summary of design parameter values corresponding to an exemplary second complementary grind plate pair, referred to as design B.

FIG. 21 illustrates a summary of design parameter values corresponding to an exemplary third complementary grind plate pair, referred to as design C.

FIG. 22 illustrates an example of more detailed design parameters output from the grind plate design program.

FIG. 24 illustrates exemplary design parameter corresponding to a prior art 52 inch single disc grind mill and a new improved 52 inch single disc grind mill.

FIG. 25 illustrates two plots comparing the prior art grind plate design and the grind plate design D of FIG. 24.

FIG. 26 illustrates comparisons on solid pass way open area for prior art grind plate designs and for new improved grind plate designs, such as grind plate designs A, B, C and D, for both 36 inch and 52 inch grind plate configurations.

DETAILED DESCRIPTION OF THE EMBODIMENTS

Figure 1:
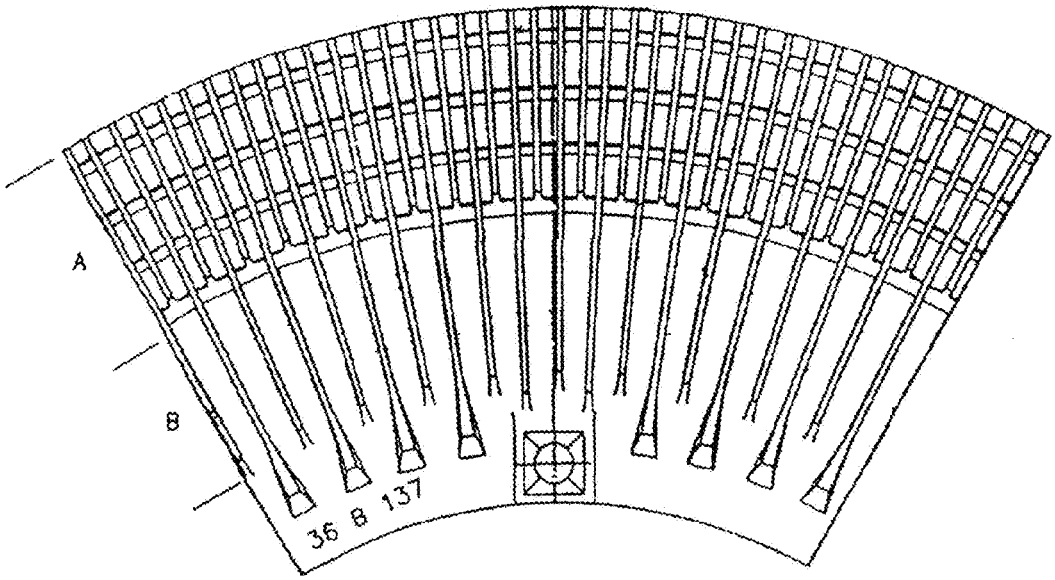
FIG. 1 illustrates to down view of a grind surface of a conventional bar and groove grind plate design.
Figure 2:
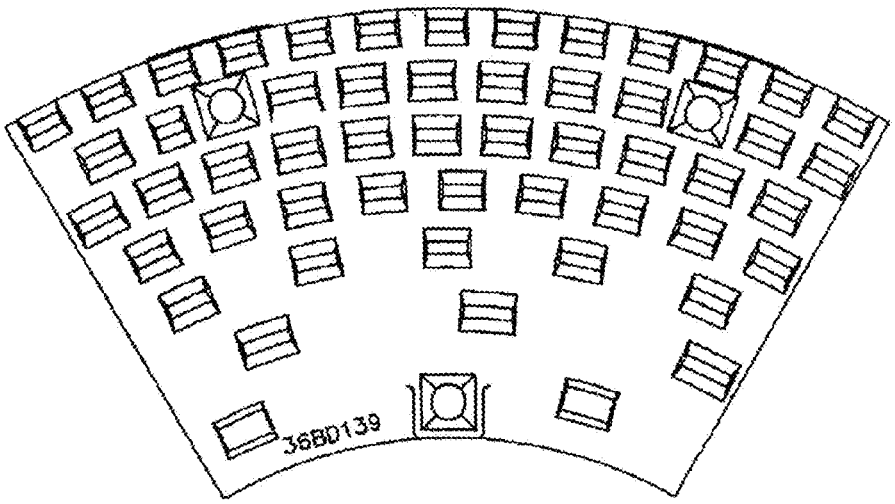
FIG. 2 illustrates a top down view of a grind surface of a conventional devil tooth design.
Figures 3A, 3B:
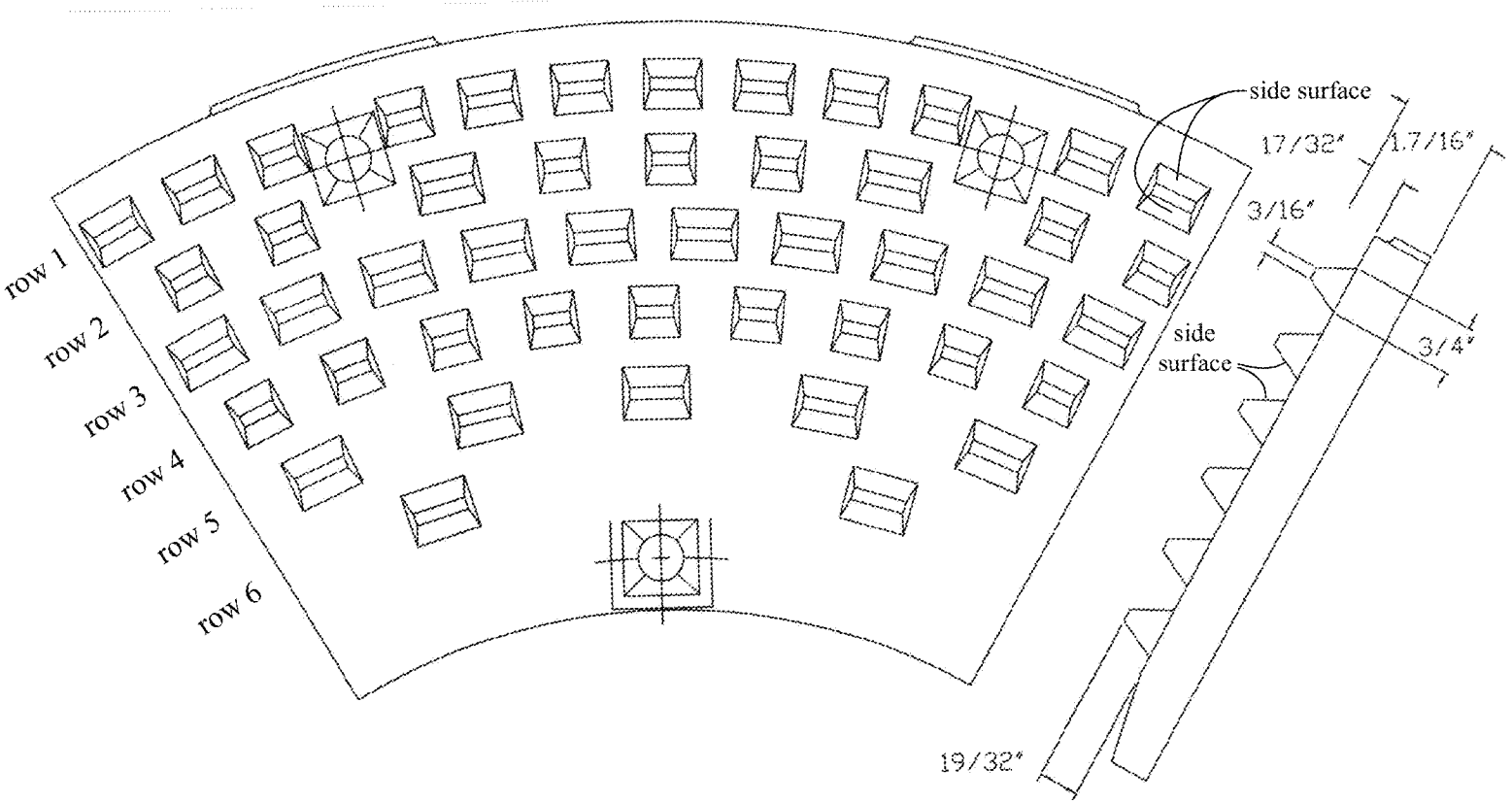
FIG. 3A illustrates a top down view of a grind plate A of a conventional devil tooth design used in the dry mill industry.
FIG. 3B illustrates a side view of the grind plate A of FIG. 3A.
Figures 4A, 4B:
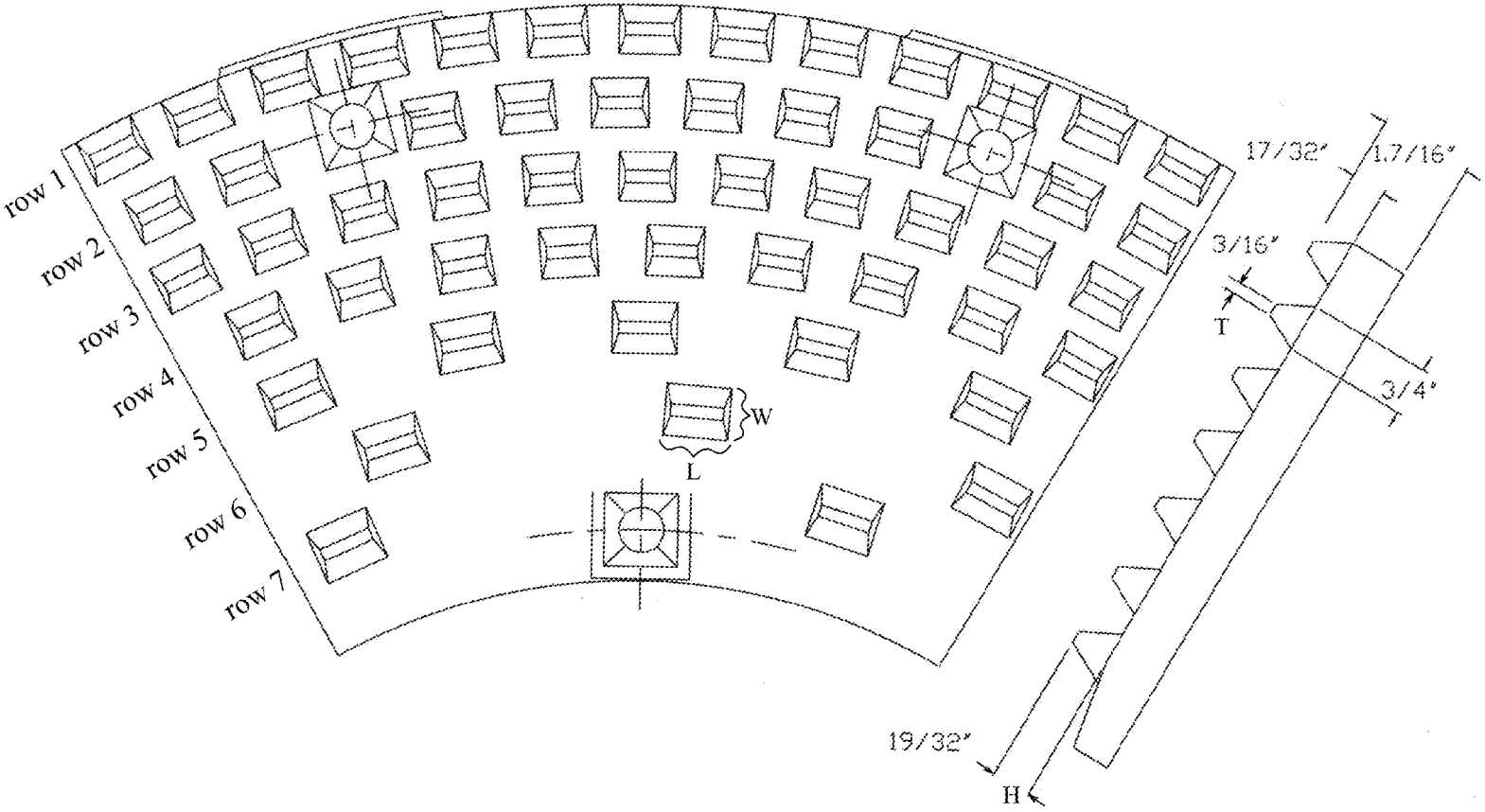
FIG. 4A illustrates a top down view of a grind plate B of a conventional devil tooth design used in the dry mill industry.
FIG. 4B illustrates a side view of the grind plate B of FIG. 4A.
Figure 5A:
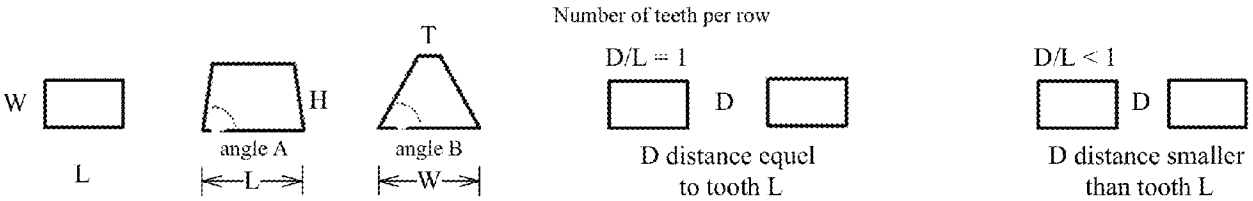
FIG. 5A illustrates detailed design parameter values corresponding to the devil tooth grind plate design.
Figure 5B:
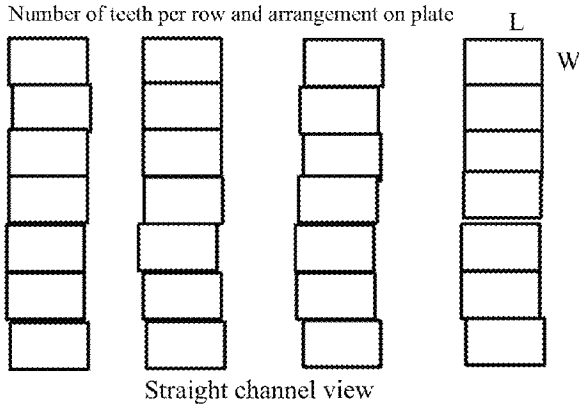
FIG. 5B illustrates a conventional straight channel configuration.
Figure 5C:
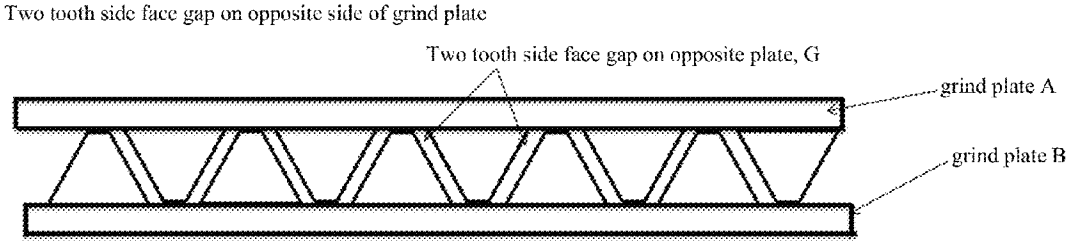
FIG. 5C illustrates a cut out side view of the of the two complementary grind plates with the two grind plates touching.

Embodiments of the present application are directed to a grind mill. Those of ordinary skill in the art will realize that the following detailed description of the grind mill is illustrative only and is not intended to be in any way limiting. Other embodiments of the grind mill will readily suggest themselves to such skilled persons having the benefit of this disclosure.

Reference will now be made in detail to implementations of the grind mill as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Embodiments of the grind mill include novel grind disc configurations. Solid material is input at the center of the grind discs and moves outward due to centrifugal force. The dry mill industry currently utilizes two sizes of grind discs, 36 inch diameter and 52 inch diameter, as previously described. Subsequent discussion is based on design parameters directed to the 36 and 52 inch diameter configurations. It is understood that similar concepts can be applied to different sized grind discs. Each grind mill includes two complementary grind discs. In some embodiments, one grind disc remains stationary while the second grind disc rotates during operation. In other embodiments, both grind discs rotate, but in opposite directions. In the embodiments described below, each grind disc is made of six grind plates, each grind plate spanning 60 degrees mounted side by side to form a 360 degree disc. Subsequent discussion is directed to a single grind plate, or complementary grind plate pair of the two complementary grind discs. It is understood that such discussion is intended for each grind plate that makes up each of the two completed grind discs. It is also understood that each grind disc can be made of more or less than six grind plates, and that the following six-grind plate design is but an exemplary embodiment.

In some embodiments, a 52 inch diameter grind disc is formed using a single ring of six grind plates. In other embodiments, a 52 inch diameter grind disc is formed using two separate rings. The first ring is formed using similar grind plates as those used to form the single ring, 36 inch diameter grind disc, and the second ring is formed around the first ring using additional grind plates. In some embodiments, the outer ring is formed using six grind plates each spanning 60 degrees, similar to the six grind plates as the inner ring except the six outer ring grind plates have a longer outer edge to account for the larger circumference of the two ring grind disc. In other embodiments, the outer ring is formed using more or less grind plates than the number of grind plates in the inner ring. For example, the outer ring is formed using 12 grind plates each spanning 30 degrees. The inner edge of the outer ring grind plates are configured to mate to the outer edge of the inner ring grind plates.

Figures 6A, 6B:
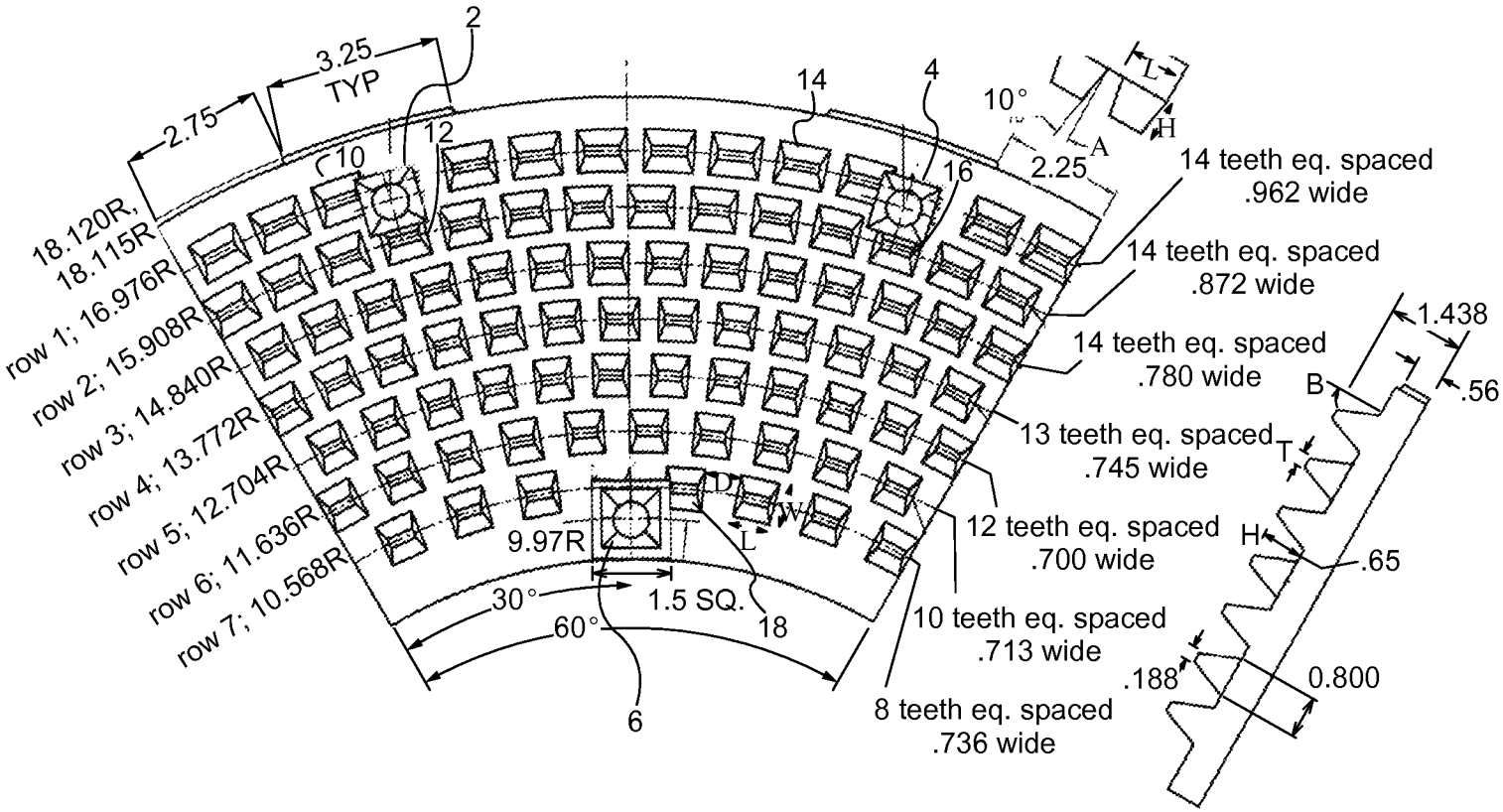
FIG. 6A illustrates a top down view of a grind plate A according to an embodiment.
FIG. 6B illustrates a side view of the grind plate A of FIG. 6A.
Figures 7A, 7B:
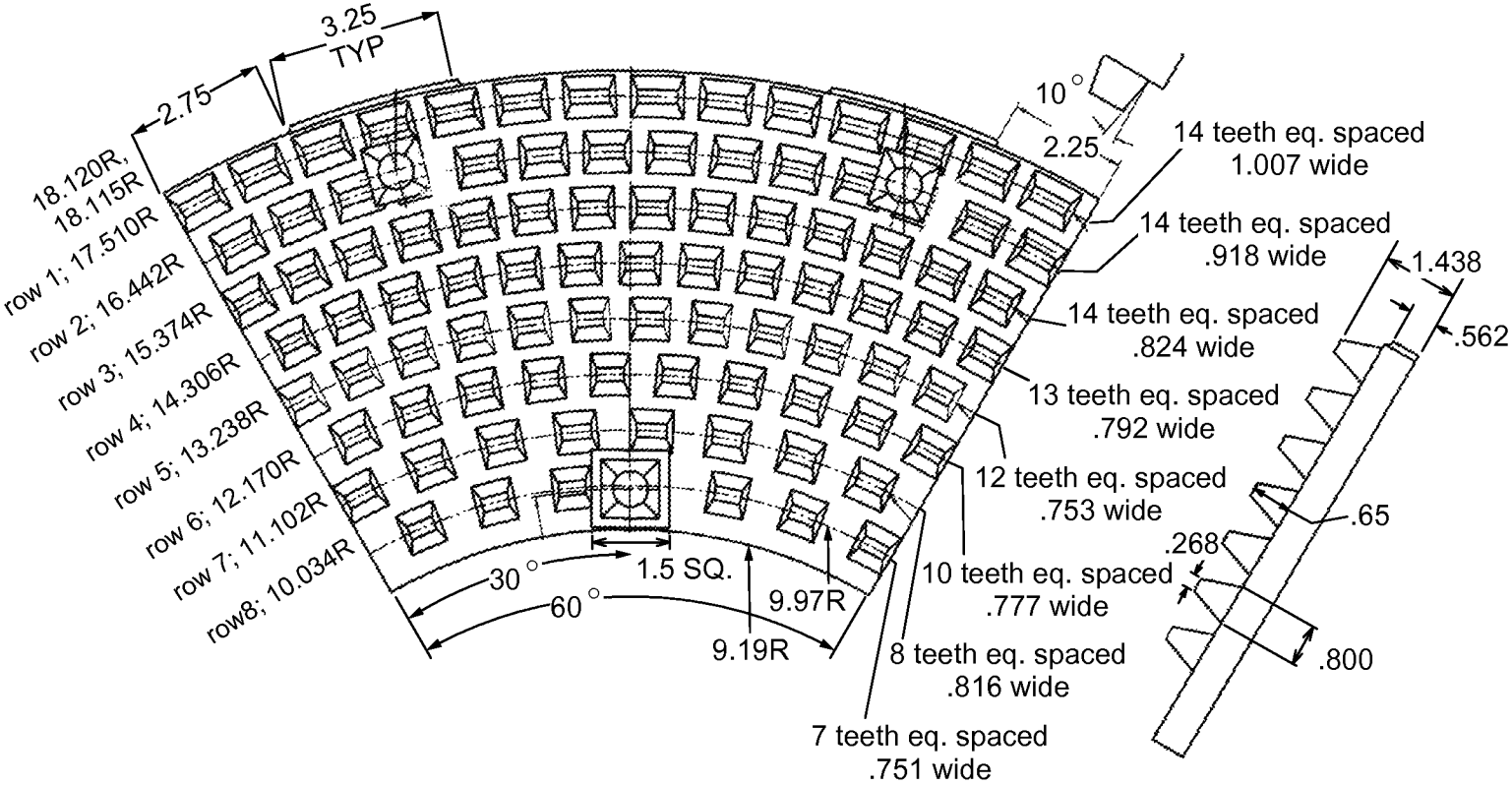
FIG. 7A illustrates a top down view of a grind plate B according to an embodiment.
FIG. 7B illustrates a side view of the grind plate B of FIG. 7A.
Figure 8:
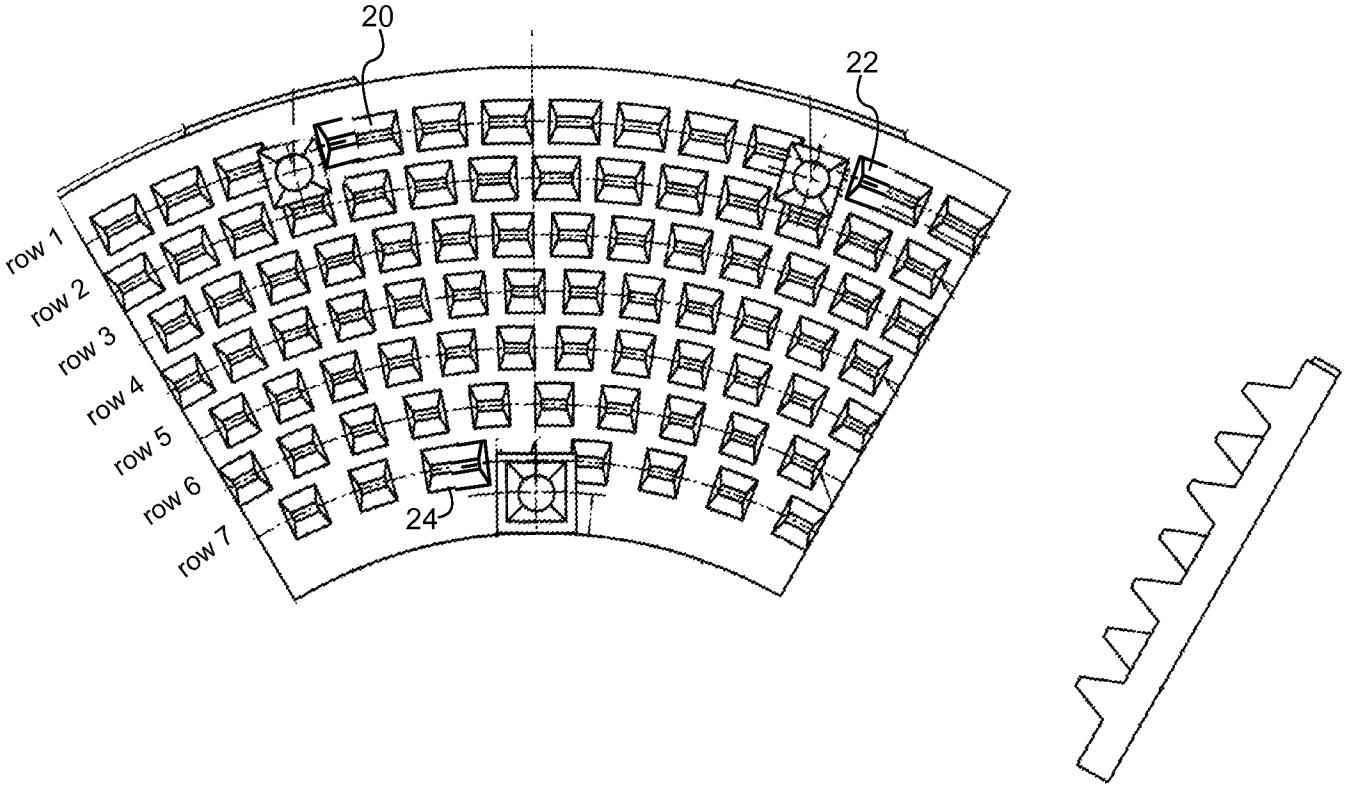
FIG. 8 illustrates a top down view of a grind plate A according to an alternative embodiment.
Figure 9:
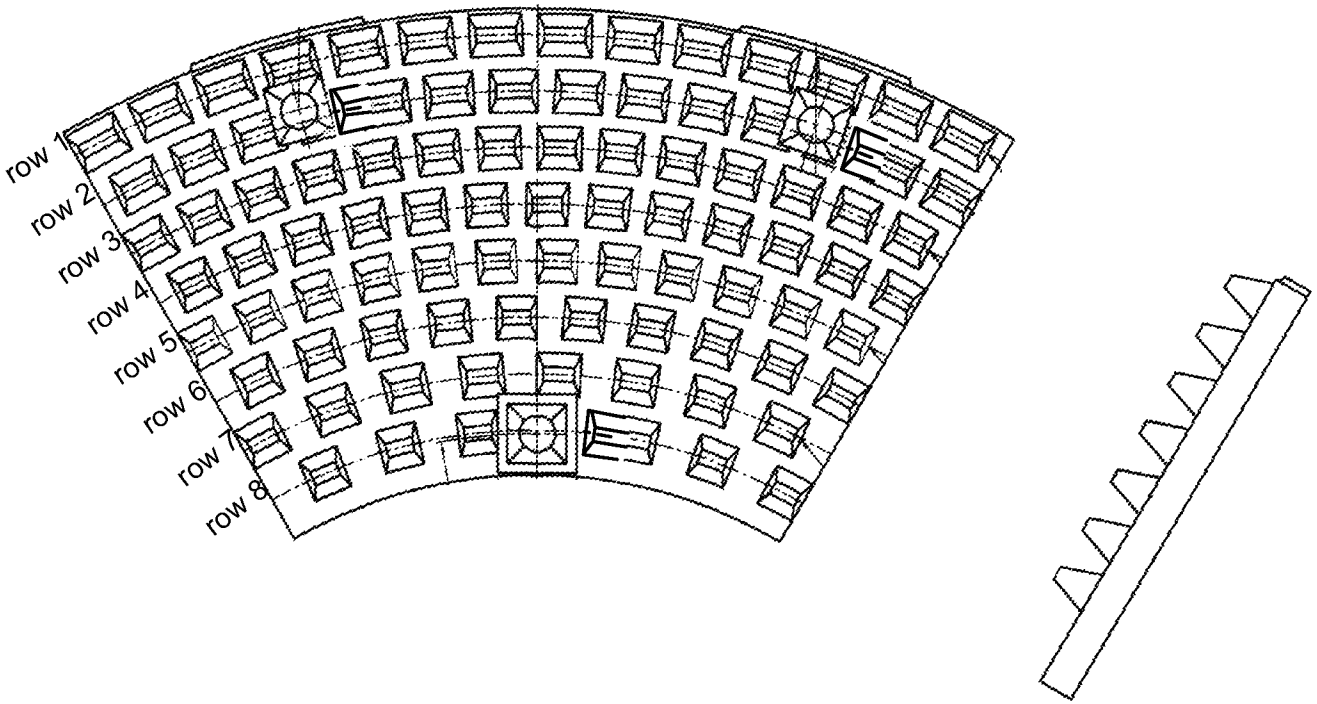
FIG. 9 illustrates a top down view of a grind plate B according to an alternative embodiment.

The grind plates are configured using a devil tooth type design. FIG. 6A illustrates a top down view of a grind plate A according to an embodiment. FIG. 6B illustrates a side view of the grind plate A of FIG. 6A. FIG. 7A illustrates a top down view of a grind plate B according to an embodiment. FIG. 7B illustrates a side view of the grind plate B of FIG. 7A. The grind plate A and the grind plate B are a complementary grind plate pair. The grinding surface of grind plate A shown in FIG. 6A faces the grinding surface of grind plate B shown in FIG. 7A such that row 1 of grind plate B is positioned between rows 1 and 2 of grind plate A, row 2 of grind plate B is positioned between rows 2 and 3 of grind plate A, and so on. The exemplary grind plate configurations shown in FIGS. 6A and 7A are modified for field use. In this case, the grind plates are secured in place, such as by bolts 2, 4 and 6 in FIG. 6A. The positions shown for bolts 2, 4 and 6 can be located in other positions on the grind plate. The number of bolts used to secure a grind plate can be more or less than the three bolts shown. In the configuration shown in FIG. 6A, inclusion of the bolts 2, 4 and 6 results in the removal, or partial removal, of co-located teeth. To accommodate the bolts, surrounding teeth may be modified, such as portions being removed as in teeth 10, 12, 14, 16 and 18 in FIG. 6A, or neighboring teeth being increased in size such as teeth 20, 22 and 24 shown in FIG. 8. Grind plate B in FIG. 7A is similarly configured for the use of bolts to secure the grind plate. As with grind plate A, inclusion of the bolts in grind plate B can result in portions of teeth being removed or some teeth being increased in size, such as shown in the alternative embodiment of grind plate B shown in FIG. 9. It is understood that alternative means for securing the grind plates can used. Subsequent discussion is based on the ideal case where all teeth in all rows remain present.

In some embodiments, each grind plate is configured with 5-8 rows of teeth. The number of rows is dependent on the tooth width W of the teeth in each row. In some embodiments, all teeth in the same row have the same tooth width W. In some embodiments, all teeth in all rows have the same tooth width W. In other embodiments, the width of the teeth in each row and/or the teeth from row to row may vary. In addition to the tooth width W, each tooth includes a tooth tip width T, a tooth base length L, and a tooth height H as shown in FIGS. 6A and 6B. Each tooth also includes a tooth front/back slope angle A and a tooth side slope angle B, as shown in FIGS. 6A and 6B.

The closer the tooth front/back slope angle A is to 90 degree the stronger the structure. For manufacturing reasons, a tooth front/back slope angle A of approximately 80 degree is used. In some embodiments, the tooth side slope angle B is in the range of about 60 to 70 degrees. The lower angle B results in a shorter tooth height with same tooth base wide, but can handle much drier solid material without forming a solid plug inside the grind discs. The higher angle B results in a higher tooth height with same tooth base wide, but with a greater chance of forming a solid plug stuck inside the grind discs.

The number of teeth N in each row can be adjusted by the tooth length L and the distance between two teeth D. The D/L ratio controls the solid pass way open area from a lower row to an upper row. In some embodiments, the D/L ratio value of each row is calculated to result in a constant solid pass way open area through out the whole grind plate. In other words, the solid path way open area is the same for each row. In some embodiments, the D/L ratio value is in the range from 1 to 2 on the inner most row and decreases gradually to a range from 0.2 to 0.5 on the outer most row. In some embodiments, the number of teeth N per row on each grind plate is selected so that the tooth length L is in the range from 0.5 W to 2 W, where W is the tooth width, for manufacturing and structural limitations. In some embodiments, the number of teeth N per row on each grind plate is in the range from 6 to 10 on the inner most row and in the range from 10 to 20 in the outer most row.

Figure 13:
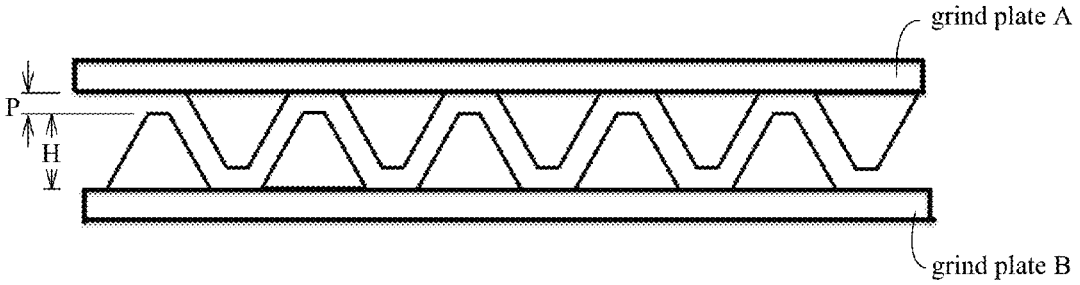
FIG. 13 illustrates a cut out side view of a portion of the complementary grind disc pair formed by grind plate A and grind plate B.

In some embodiments, all teeth in the same row have the same tooth dimensions. In some embodiments, the tooth height H is the same from row to row. In other embodiments, the tooth height H has a small variation from row to row to control a solid pass way open area. Conceptually, the solid path way open area is the open space on the grind plate. In some embodiments, the solid path way open area for a specific row on one of the grind discs is defined as the circumference through the center of the teeth in the specific row multiplied by the valley to valley distance (height of tooth H plus plate gap P) minus the cross-sectional area of all the teeth in the row, where the cross section is taken at the center of the teeth. The circumference is defined as $2\pi R$, where R is the radius from the center of the grind disc to the center of the teeth in the specific row. The plate gap P is defined as the distance between the tip of the teeth on one grind plate, such as grind plate A, and the surface of the other grind plate, such as grind plate B, opposite the tip of the teeth. FIG. 13 illustrates a cut out side view of a portion of the complementary grind disc pair formed by grind plate A and grind plate B. An exemplary row of grind plate B is calculated by multiplying the circumference at the center of the row by the valley to valley distance between grind plate A and grind plate B, where the valley to valley distance is the teeth height H plus the plate gap P. The cross-sectional area of the teeth in the row are subtracted from this product, the result of which is the solid path way open area for the row. The cross-sectional area of the teeth is shown by the darkened teeth in FIG. 13. It is understood that the solid path way open area for a specific row can be alternatively calculated. For example, the circumference can be calculated using a radius different than that corresponding to the center of the teeth in the row. The solid path way open area can also be calculated as a volume. For example, the solid pass way open area can be calculated as the width of the teeth in row X multiplied by the valley to valley distance (the teeth height H plus the plate gap P) integrated around the entire circumference of the row (e.g. the outer edge of tooth radius minus inner edge of tooth radius) minus the volume of all the teeth in the row.

In some embodiments, the solid path way open area can also be calculated without reference to both grind plates. For example, a specific row on grind plate A can be calculated as if the plate gap P is zero, in which case the grind plate A and the grind plate B are touching, as in the top configuration in FIG. 11. In this case, the valley to valley distance used in the solid path way open area calculation is merely the tooth height H. As such, the solid path way open area for the specific row can be calculated as the circumference through the center of the teeth in the specific row multiplied by the tooth height H minus the cross-sectional area of all the teeth in the row.

Figure 12:
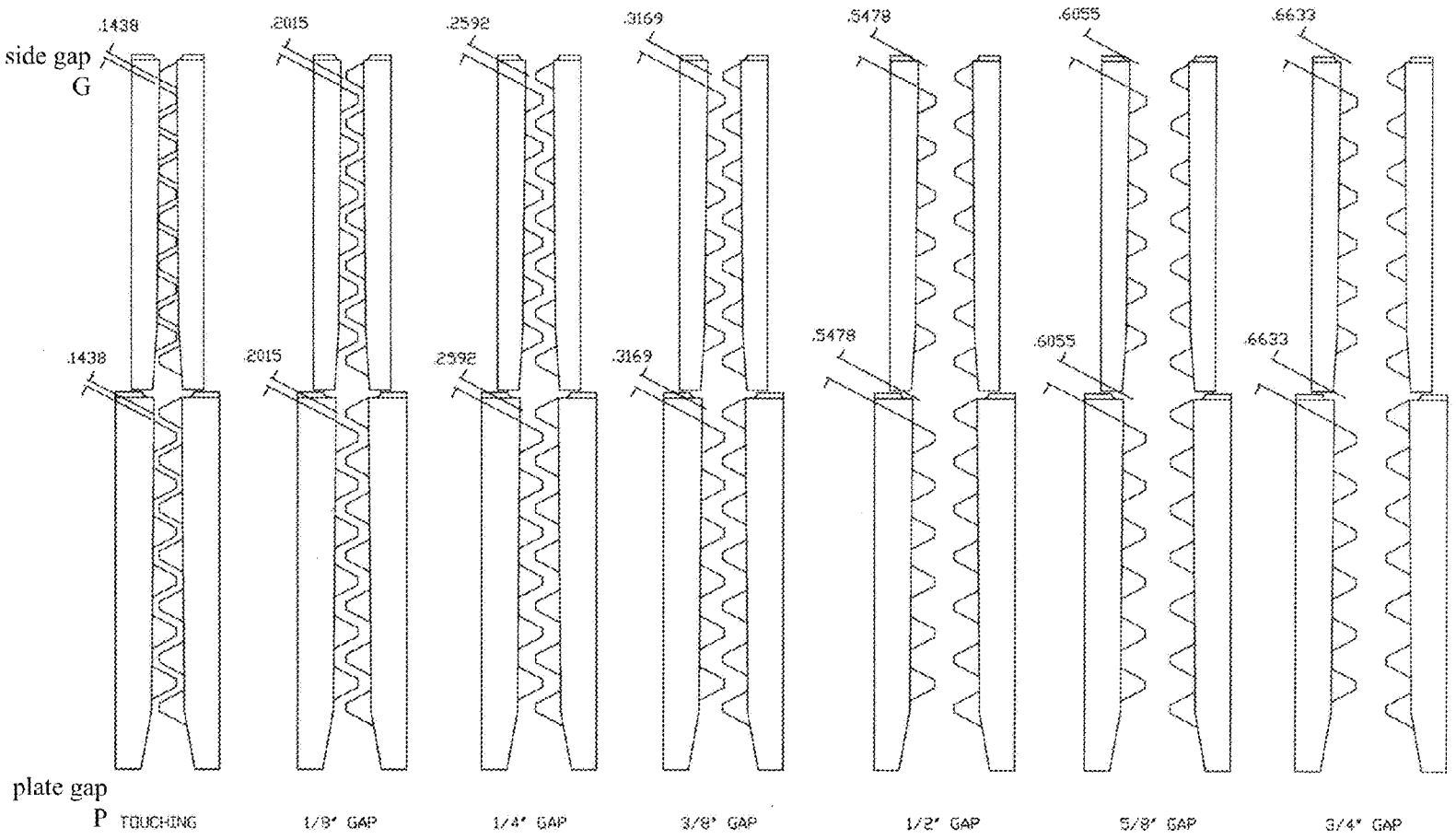
FIG. 12 illustrates a cut out side view of an exemplary 52 inch grind plate complementary grind plate pair and the affect of varying the plate gap P.

The value of the plate gap P is set to achieved a desired separation between the grind plates and the active grind surfaces of the complementary teeth. FIG. 12 illustrates a cut out side view of an exemplary 52 inch grind plate complementary grind plate pair and the affect of varying the plate gap P. As shown in the far left view, the grind plate complementary pair are touching, and therefore the plate gap P is zero. In some embodiments, the plate gap P is constant for all teeth in the same row and for all teeth in all rows. In other embodiments, the plate gap P varies from row to row and/or from teeth to teeth within a given row. As shown in FIG. 12, the plate gap P varies from row to row. In this exemplary configuration, the value of the plate gap P is described in reference to the top most row of teeth. In this exemplary configuration, the side gap G is 0.1438 inches with the plate gap P equal to zero. As shown in FIG. 12, as the plate gap P is increased, the side gap G is also increased.

The grind plates A and B are spaced to provide a solid path way through which the solid material to be ground can pass. The actual grind surface of the devil tooth grind plate design is considered the tooth side surface. The solid material passes through the side gap G between two tooth side surfaces with relative speed, where one grind plate is stationary and the other grind plate is rotating, or both grind plates are rotating but in opposite directions. In some embodiments, the side gap G is uniform for all teeth in the complementary grind disc.

In typical operation, the two grind plates are separated to give some plate gap P. The value of plate gap P is set depending on the grind mill design and the solid material load provided. As used herein, "load" is considered to be the rate at which the solid material is input into the grind mill, e.g. the volume of solid material per period of time delivered through the feed pipe. The load is also considered to be a function of the type of solid material that is being input. For lower solid material load the plate gap P is typically set from 1/32 inch to 1/16 inch. For higher solid material load the plate gap P is typically set from 1/4 inch to 1/2 inch.

Figure 10:
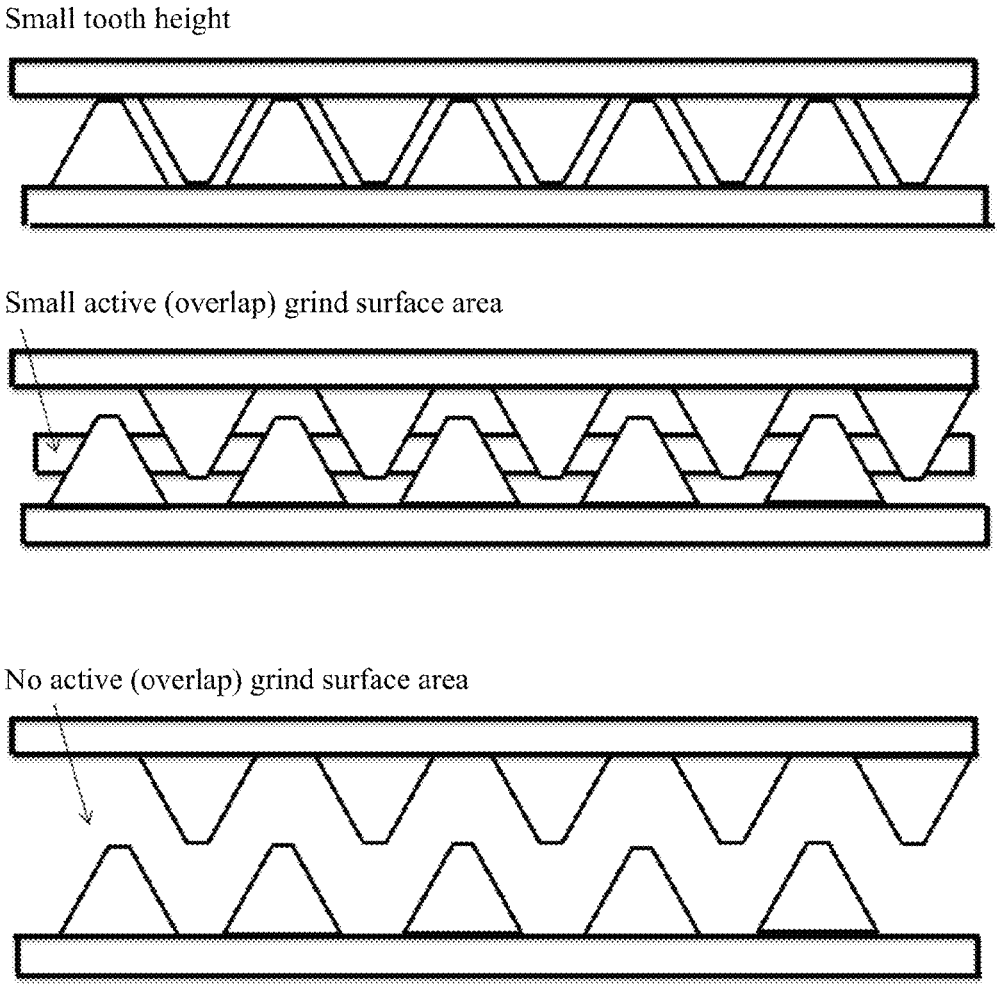
FIG. 10 illustrates a cut out side view of an exemplary complementary grind plate pair and the affect of varying the plate gap P on the over lapping grind surfaces.
Figure 11:
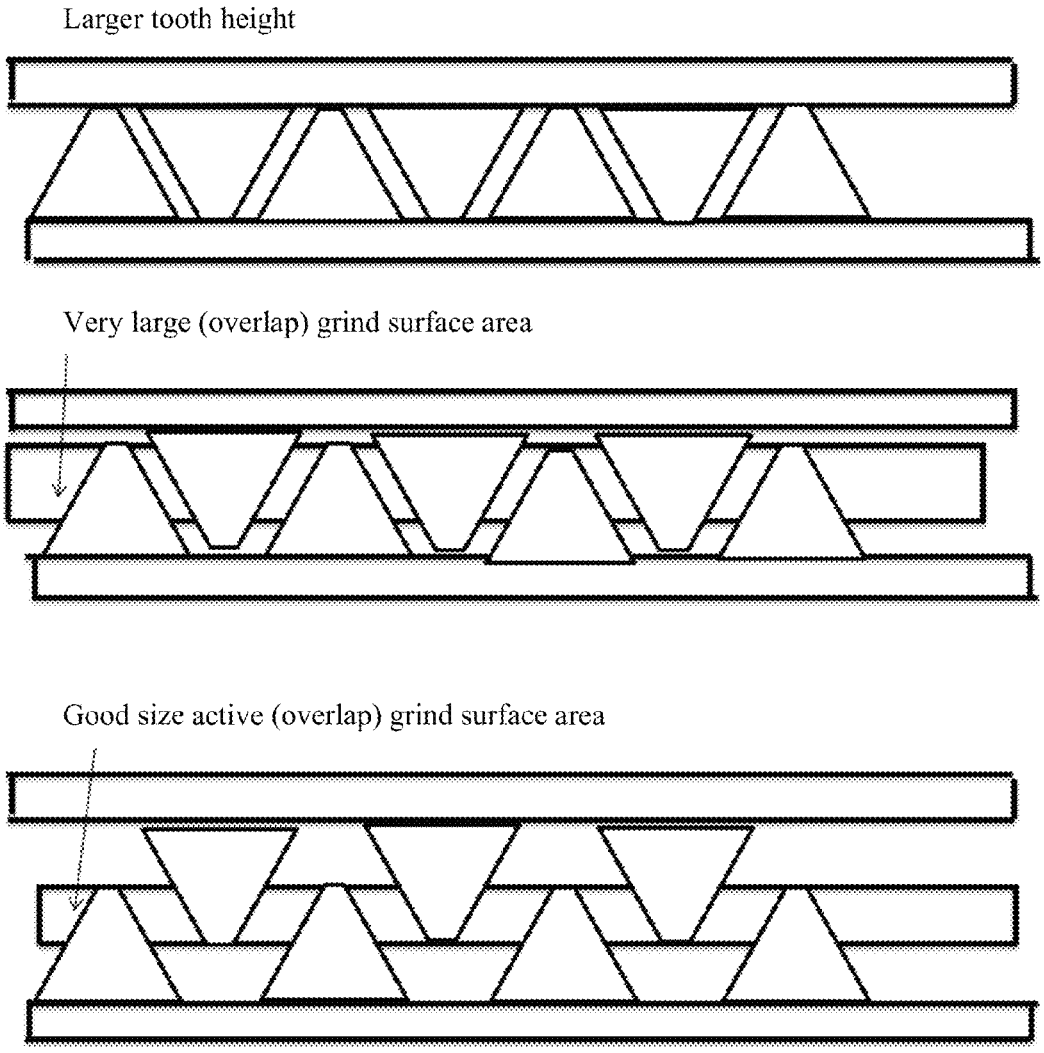
FIG. 11 illustrates a cut out side view of an exemplary complementary grind plate pair and the affect of varying the plate gap P and the tooth height H on the over lapping grind surfaces.

The value of the plate gap P also influences the amount of over lap between two complementary side tooth surfaces on opposite grind plates. The overlapping grind surfaces provide the grinding surfaces for grinding the solid material. FIG. 10 illustrates a cut out side view of an exemplary complementary grind plate pair and the affect of varying the plate gap P on the over lapping grind surfaces. In the top illustration, the plate gap P is zero and the entire tooth side surface forms an overlapping grind surface. As the plate gap P is increased, as in the middle illustration, the overlapping grind surface area is decreased until eventually the plate gap P reaches a point, as in the bottom illustration, where there is no overlapping grind surface. FIG. 11 illustrates a cut out side view of an exemplary complementary grind plate pair and the affect of varying the plate gap P and the tooth height H on the over lapping grind surfaces. The teeth in FIG. 11 have a greater tooth height H than the teeth in FIG. 10. In the top illustration of FIG. 11, the plate gap P is zero and the entire tooth side surface forms an overlapping grind surface. Since the tooth height H is greater in FIG. 11, the overlapping grind surface area is greater in the configuration shown in FIG. 11. As the plate gap P is increased, the overlapping grind surface area is decreased. However, the larger tooth height H provides a greater overlapping grind surface area for the same valley to valley grind plate separation. For example, the middle illustrations in FIGS. 10 and 11 show the same valley to valley grind plate separation, H+P, but the configuration in FIG. 11 has a greater overlapping grind surface area. The bottom illustration in FIG. 10 and all also show the same valley to valley grind plate separation, but the configuration in FIG. 11 still maintains an overlapping grind surface area whereas the configuration in FIG. 10 does not.

Figure 16:
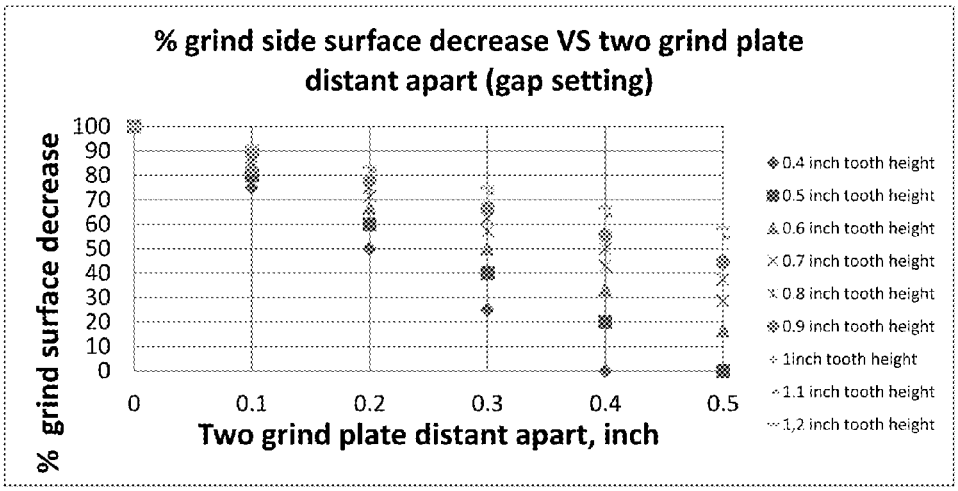
FIG. 16 illustrates the % active grind surface decrease with increase of the grind plate gap P.
Figure 17:
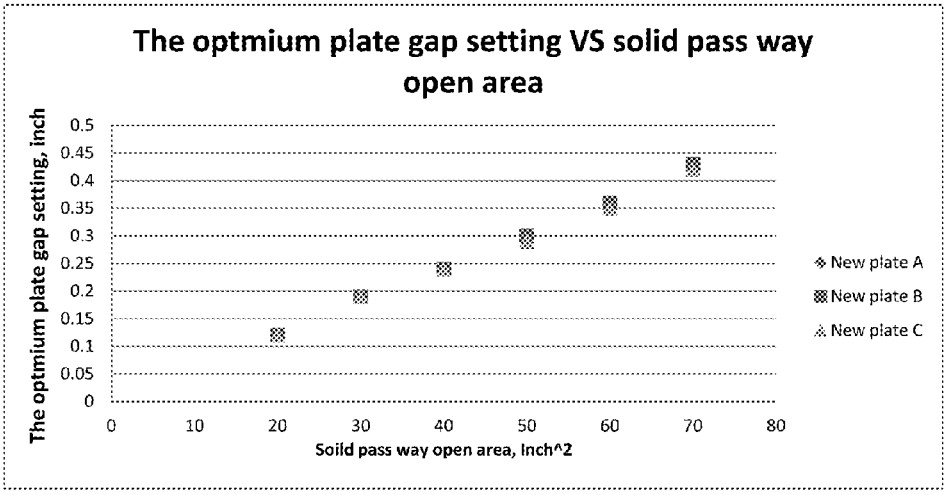
FIG. 17 illustrates exemplary optimum plate gap P settings for given solid pass way open area values.

In an exemplary comparison, if the tooth height H is in range of 0.42 inch to 0.58 inch and the plate gap P is set as 1/2 inch, then the two tooth side surfaces on opposite grind plates are far apart and there is no grind action between the two tooth side surface, as show in FIG. 12. A greater tooth height H, for example 0.9 inch, has 0.4 inch over lap between two tooth side surfaces with a 1/2 inch plate gap P. This provides an approximate 40% effective grind surface, as compare with 0% effective grind surface for tooth height only 0.5 inch. FIG. 16 illustrates the % active grind surface decrease with increase of the grind plate gap P. Increasing the plate gap P provides a greater solid pass way open area for high solid material load to pass through, but an increase in the plate gap P decreases the two tooth side surface over lap. As such, there is an optimum value of the plate gap P for each solid material load. FIG. 17 illustrates exemplary optimum plate gap P settings for given solid pass way open area values.

The size of the plate gap P and the side gap G also affects the solid material throughput capacity. The greater the gaps, the greater the throughput capacity. However, the smaller the gaps, the smaller the throughput capacity. As such there is a design tradeoff between increased active (over lap) grind surface and throughput capacity. Designing a grind plate having greater tooth height H as described above enables increased active grind surface for the same size of size gap G. or in other words enables more active grind surface with increased throughput capacity.

The wide of the tooth tip T is limited by the material strength. In an exemplary configuration, the tooth tip width T is 0.188 inch to avoid braking teeth during operation. The wide of the tooth base W can be adjusted depend on the desired number of row. A smaller tooth base width W gives more rows, and a larger tooth base width W gives fewer rows. Since a maximum tooth height H is a function of the tooth base width W, as described below, and a larger tooth height H provides a larger grind capacity, the larger tooth base width W also provides more grind surface per tooth. However, the larger tooth base width W also results in reduced solid pass way through the grind surface. The larger tooth base width W also results in a fewer number of rows N. As such, there is an optimum tooth base wide W for each size grind mill. For a 36 inch diameter grind mill, in some embodiments the tooth base width W is in the range from about 0.8 inch to 1.2 inch depend on type and size of solid material to be ground. For a 52 inch diameter grind mill, in some embodiments the tooth base width W is in the range from about 0.8 to 1.2 inch for the lower ring, and in the range from about 0.6 to 1 inch for the upper ring. FIG. 19 illustrates a summary of design parameter values corresponding to an exemplary first complementary grind plate pair, referred to as design A. In design A, the tooth base width W is 0.8 inch for 36 inch diameter single or double disc. FIG. 20 illustrates a summary of design parameter values corresponding to an exemplary second complementary grind plate pair, referred to as design B. In design B, the tooth base wide W is 1.09 inch for higher capacity, or load, 36 inch diameter single or double disc. FIG. 21 illustrates a summary of design parameter values corresponding to an exemplary third complementary grind plate pair, referred to as design C. In design C, the tooth base wide W is 1.2 inch for higher capacity 36 inch diameter double disc and 52 inch diameter lower ring. It is understood that each of the exemplary designs A, B and C can be used in 36 inch diameter single or double disc as well as 52 inch diameter single or double disc configurations. The exemplary design parameters shown in FIGS. 19, 20 and 21 are results output from a grind plate design program. An example of more detailed design parameters output from the grind plate design program are shown in FIG. 22. The design parameter values shown in FIG. 19 is a summary of the more detailed design parameter values shown in FIG. 22. The design program is used to find optimum grind plate design parameter values for a variety of applications including, but not limited to, the solid material load, the solid material particle size and the degree of grind required, such as fine or course.

FIG. 22 is referred to as an example of how the design program functions. The cells D7:D21 include the number of rows on one grind plate, such as grind plate B, and the cells E7:E21 include the number of rows on the other grind plate, such grind plate A. The cells F7:F21 include the tooth base wide W on each row, in this example 0.8 inch is used for all rows on both plates. The cells G7:G21 include a valley wide on each row. The valley wide is the sum of the tooth tip wide T, included in cells O7:O21 (0.188 inch in this example) plus two times the tooth side gap G, included in cells Q7:Q21 (0.04 inch in this example). A larger value for the tooth side gap G is used, such as 0.08 inch, for course grinding into larger solid particles. A smaller value for the tooth side gap G is used, such as the 0.04 inch value shown in FIG. 22, for fine grinding into smaller solid particles. The value of the tooth side gap G can be as small as manufacturing tolerance limitations to give the finest grind. The cell E4 includes the slope of the tooth side surface as determined by the tooth side angle B. In this example the slope of the tooth surface is 0.41.

The tooth height H should be smaller than tooth base wide W per manufacturing (casting) limitations. But larger tooth height H gives larger grind capacity. In some embodiments, the tooth height-to-tooth base width (H/W) ratio is in the range from 0.8 to 1. This compares to a conventional H/W ratio in the range of 0.4 to 0.5. In some embodiments, the grind plates are made of stainless steel with high nickel and chrome content, such as conventional white iron, and the range of 0.8 to 1 for the H/W ratio is for a grind plate made of such material. For a H/W ratio larger than 1 other material is to be used. The cells H4:L21 include the calculated radius locations of each row of tooth and valley. The cells M7:M21 include a mountain height for each tooth in the row. The mountain height is a maximum height for each tooth in the row. The cell N7:N21 includes a tooth height T. The tooth height T can be equal to or greater than the mountain height.

During normal operation, the two grind plates are set some distance apart as identified by the plate gap P, an exemplary distance is typically in the range of about 0.05 inch to 0.4 inch depending on the solid load and degree of grinding required. A smaller separation distance provides more active grinding surface area which requires more power. The cells R4:V21 is simple calculation of total space open area for solid pass through from small radius (inner most row) to larger radius (outer most row) without consideration for the area of the teeth in the row. The total open space area is calculated for different values of the plate gap P, shown in cells R6, S6, T6 and U6. The total open area for each row is calculated using the radius to the center of the teeth in the row. The total space open area contrasts with the solid pass way open area which does account for the area of the teeth in the row. As shown in cells R7:V21, the total space open area increases from the smaller radius to the larger radius. For minimum power used and maximum grinding efficiency, the grind plate is designed with constant solid pass way area through each row. The ratio of distance between tooth separation distance/tooth length, D/L, is used to adjust the solid pass way open area of each row to be constant from row to row. The cell Z3 includes the desired design value for the solid pass way open area which is 35 inch^2 in this example, and the cell AC6 includes the desired design value for the plate gap P which is 0.15 inch in this example. The values for the solid path way open area and the plate gap P are selected based on previously collected empirical data. The design program calculates the D/L ratio in cells Z7:Z21 for providing constant solid pass way open area of 35 inch^2 on each row, as shown in cells AC7:AC21. The cells AD7:AG21 include calculated values for the solid pass way open area using the same D/L ratios from cells Z7:Z21 but for different values of the plate gap P, as shown in cells AD6, AE6, AF6 and AG6 having plate gap P values of 0.05, 0.1, 0.15 and 0.2 respectively. A shown in FIG. 22, the solid pass way open area is only constant from row to row for plate gap P equal to 0.15 inch. This is because the solid pass way open area values are a function of the D/L ratios, and the D/L ratios were calculated using the desired plate gap P value of 0.15 inch. In order to achieve constant solid pass way open area for each row using different values of the plate gap P, different D/L ratios must be calculated. Referring to the values shown in FIG. 22, the solid open area decreases with smaller plate gap P, and the solid pass way open area decreases from the bottom (inner most) row to top (outer most) row. Conversely, the solid pass way open area increases from bottom row to top row the larger the value of the plate gap P. The cells Y7:Y21 includes the number of teeth N in each row. The cells AA7:AA21 include the calculated values of the tooth length L for each row. The cells AB7:AB21 include the calculated values for the tooth separation distance D for each row. In some embodiments, the tooth length L is in the range from 0.5 inch to 1 inch. Teeth with too small a tooth length may easily brake. Teeth with too long a tooth length decrease the cutting/grinding edge and decrease the grinding efficient. For example, a tooth of length L can be replaced by two teeth each of length 0.5 L. The corners of each tooth also providing grinding action, and as such for the same length L, the two teeth of length 0.5 L have double the amount of corners for grinding as does the single tooth of length L.

The cells AM7:AO21 include the grind surface area (front and back surface combined, upper and lower surface combined, and the total) on each row. During normal grinding operation, the two grind plates are separated by a non-zero value of the plate gap P, about 1/32 inch to 1/8 inch for good operation, and 3/8 to 1/2 inch for poor operation. Good operation is considered operation at maximum power consumption. As the value of the plate gap P increases, the active (over lap) grind surface area between opposing tooth side surfaces decreases. The active (over lap) grind surface area is calculated in the cells AH7:AL21 which depends on the value of the plate gap P, assigned in cells AH6, AI6, AJ6, AK6 and AL6. The cells AP7:AP21 include the total available grind power, which is the over lap grind surface area multiplied by the tooth tip speed. The cell AP22 includes the total available grind power.

The cells AQ7:AQ21 include the grind plate base thickness. The thickness must meet the manufacture minimum thickness requirement for casting. In some embodiments, the grind plate base thickness is about the same as the tooth base wide W.

Figure 14:
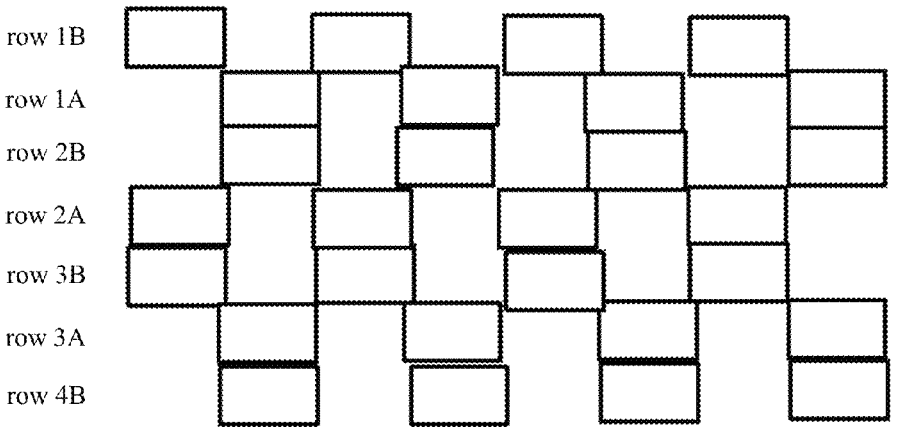
FIG. 14 illustrates a block channel tooth configuration.

In some embodiments, the positions of the teeth in one row are positioned relative to the positions of the teeth in adjacent rows so as to avoid solid material passing from a lower row to an upper row without passing through the tooth side gap for grinding action. FIG. 14 illustrates a block channel tooth configuration. The tooth pattern arrangement of the block channel tooth configuration positions a tooth in the open space between teeth in an immediately adjacent row. In this manner, the tooth blocks the space between two teeth in the most immediate lower row. To provide a 100% block, the tooth length L on the upper row is larger than distance between two tooth D on the immediate lower row. Referring again to FIG. 22, the % block on each row is calculated in cells AU7:AV21. The values shown in cells AU7 are the percentages of a given row in grind plate A relative to the adjacent row in grind plate B, whereas the values shown in cells AV7 are the percentages of a given row in grind plate B relative to the adjacent row in grind plate A.

In some embodiments, the tooth front/back slope angle A on the front and back face is about 80 degrees. Although the maximum value for the tooth side slope angle A is 90 degrees, 80 degrees is typically used for casting reasons. The tooth side slope angle (top face/bottom face) is determined according to the tooth base width W, the tooth tip width T, the tooth height H and the tooth side gap selected. In some embodiment, the tooth side slope angle B is in the range of about 60 to 70 degrees. A larger angle B is preferred for wet and small solid particle feed, and a smaller angle B is preferred for dry and larger solid particle feed. The tooth side slop angle B is calculated in cells AW7:AW21

Figure 23:
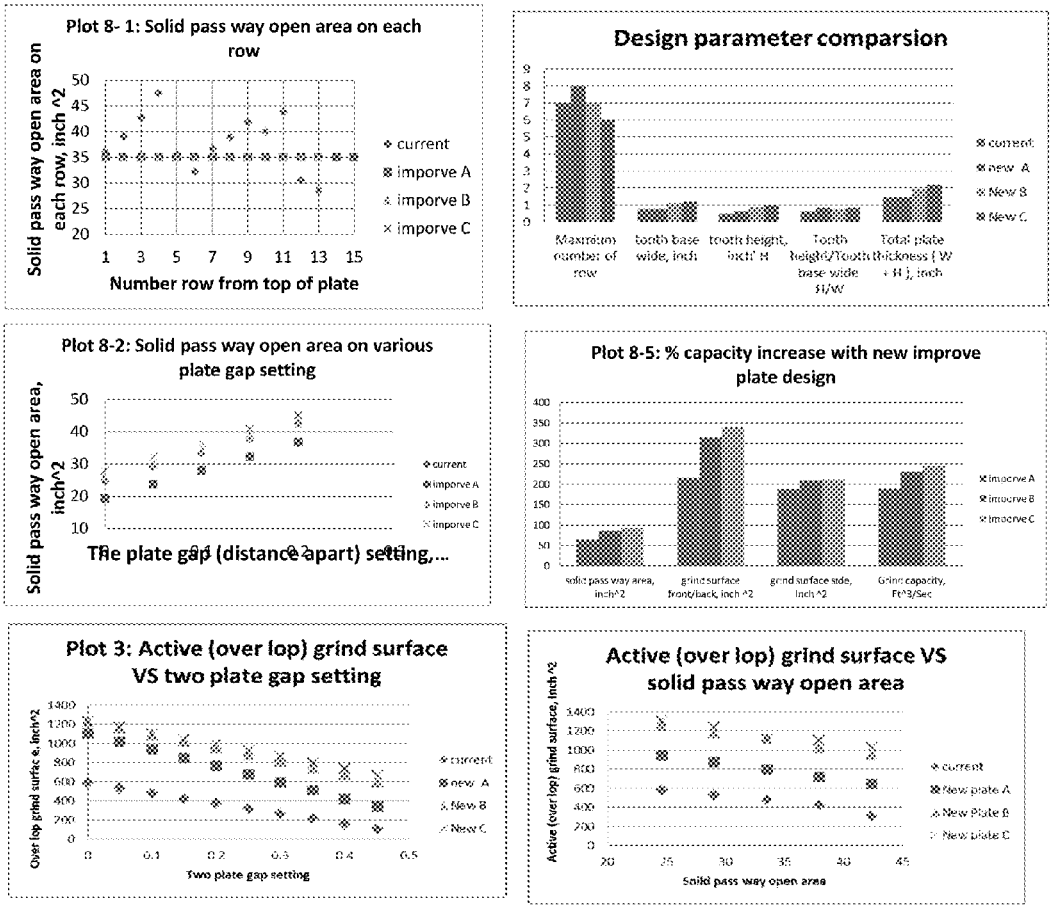
FIG. 23 illustrates a detailed comparison of the new grind plate designs A, B and C parameter values shown in FIGS. 19, 20 and 21 with the prior art design parameter values shown in FIG. 18.

The design parameters included in FIG. 22 are used to form the grind plates A and B shown in FIGS. 6A and 7A, respectively. The process described above in relation to FIG. 22 can be repeated for any design parameters, such as alternative tooth width W values and tooth height T values, to design alternatively configured grind plates. FIG. 20 illustrates the alternatively configured grind plate design B parameter values with the tooth base wide W equal to 1.09 inch and the tooth height H equal to 0.876 inch. FIG. 21 illustrates an alternatively configured grind plate design C parameter values with the tooth base wide W equal to 1.2 inch and the tooth height H equal to 0.981 inch. FIG. 18 illustrates design parameter values corresponding to an exemplary prior art grind plate design. A detailed comparison of the new grind plate designs A, B and C parameter values shown in FIGS. 19, 20 and 21 with the prior art design parameter values shown in FIG. 18 is illustrated in FIG. 23. Referring to FIG. 23, plot 1 shows the solid pass way open area is constant 35 inch^2 on all new grind plate designs A, B and C, but the prior art grind plate design varies from 22 to 48 inch ^2. Plot 2 shows the solid pass way open area increases with increased separation of the two grind plates for all four grind plate designs. Plot 3 shows the active grind surface decreases with increasing separation of the two grind plates, and the new grind plate designs A, B and C show greater active (over lap) grind surface area for all plate gap distances. Plot 5 shows the % capacity increases with the new grind plate designs A, B and C.

The above discussion is primarily directed to a 36 inch diameter single and double disc grind mill. FIG. 24 illustrates exemplary design parameter corresponding to a prior art 52 inch diameter single disc grind mill and a new improved 52 inch single disc grind mill. The new improved 52 inch diameter single disc grind mill design is referred to as grind plate design D. Table A in FIG. 24 refers to a lower ring of the prior art grind plate and Table B refers to an upper ring of the prior art grind plate. Table C in FIG. 24 refers to a lower ring of the grind plate design D, and Table D refers to an upper ring of the grind plate design D. The upper ring of the 52 inch diameter single disc grind plate design D is configured with 12 grind plates each spanning 30 degrees, with tooth height H of around 0.6 inch to 1.0 inch. Table D shows design parameter values for the grind plate design D upper ring having tooth base wide W of 0.82 inch and tooth height H of 0.613 inch. The solid pass way open area is approximately 77 inch^2 per row for the upper ring. The solid pass way open area on lower ring is to match the upper ring so the solid material has smooth transaction from the lower ring to the upper ring. The solid pass way open area on lower ring with plate gap P equal to 0.45 inch varies from 67.4 to 82.76 inch^2 with an average of 75 Inch^2 using calculations based on the grind plate design B. If the grind plate base thickness for the stationary grind plate of the 52 inch diameter single disc grind plate design B is increased 0.1 inch on top (1.1 inch thickness on top instead of 1 inch) and decreased 0.1 inch thickness on bottom (0.9 inch on bottom instead of constant 1.0 inch), then the solid pass way open area decreases on the top rows because the top portion of the stationary grind plate is now closer to the rotating grind plate and increases on the bottom rows because the bottom portion of the stationary grind plate is now further from the rotating grind plate. This results in a nearly constant solid pass way open area of 77 inch^2 for each row in the upper ring. It is understood that the above discussion directed to a 52 inch diameter single disc can also be applied to a 52 inch diameter double disc.

FIG. 25 illustrates two plots comparing the prior art grind plate design and the grind plate design D of FIG. 24. Plot 11-1 shows the solid pass way open area is a constant 77 inch^2 on all row in the grind plate design D, whereas the prior art grind plate design ranges from about 42 to 106 inch^2. Plot 11-2 shows active grind surface area on each row for both the prior art grind plate design and the grind plate design D. The active grind surface area on the grind plate design D is much higher, more than 300%, than the prior art grind plate design. FIG. 26 illustrates comparisons on solid pass way open area for prior art grind plate designs and for new improved grind plate designs, such as grind plate designs A, B, C and D, for both 36 inch and 52 inch grind plate configurations.

Field test of the 52 inch grind mill has been performed to grind a 100 MGY plant. For grind plate gap P setting from ⅜ inch to ½ inch, power consumption is from 700 to 950 HP. Using the prior art configuration, for tooth height in the range of 0.42 inch to 0.58 inch, the total active (over lap) grind surface area is low, less than 300 inch^2, as show in FIG. 24, Tables A and B. The active (over lap) grind surface area with the new improved design having tooth height of 0.876 for lower ring and 0.613 for upper ring is 925 inch^2, an increase of 309%.

Field test of the 36 inch double disc grind mill on a 65 MGY plant, with the plate gap P setting for ⅜ inch consumes about 500 HP. As show in FIG. 23, plot 3, the new improve grind plate design B with tooth height of 0.9 inch results in an increase of the active (over lap) grind surface area from 175 to 682 inch^2, an increase of 389%.

Figure 15:
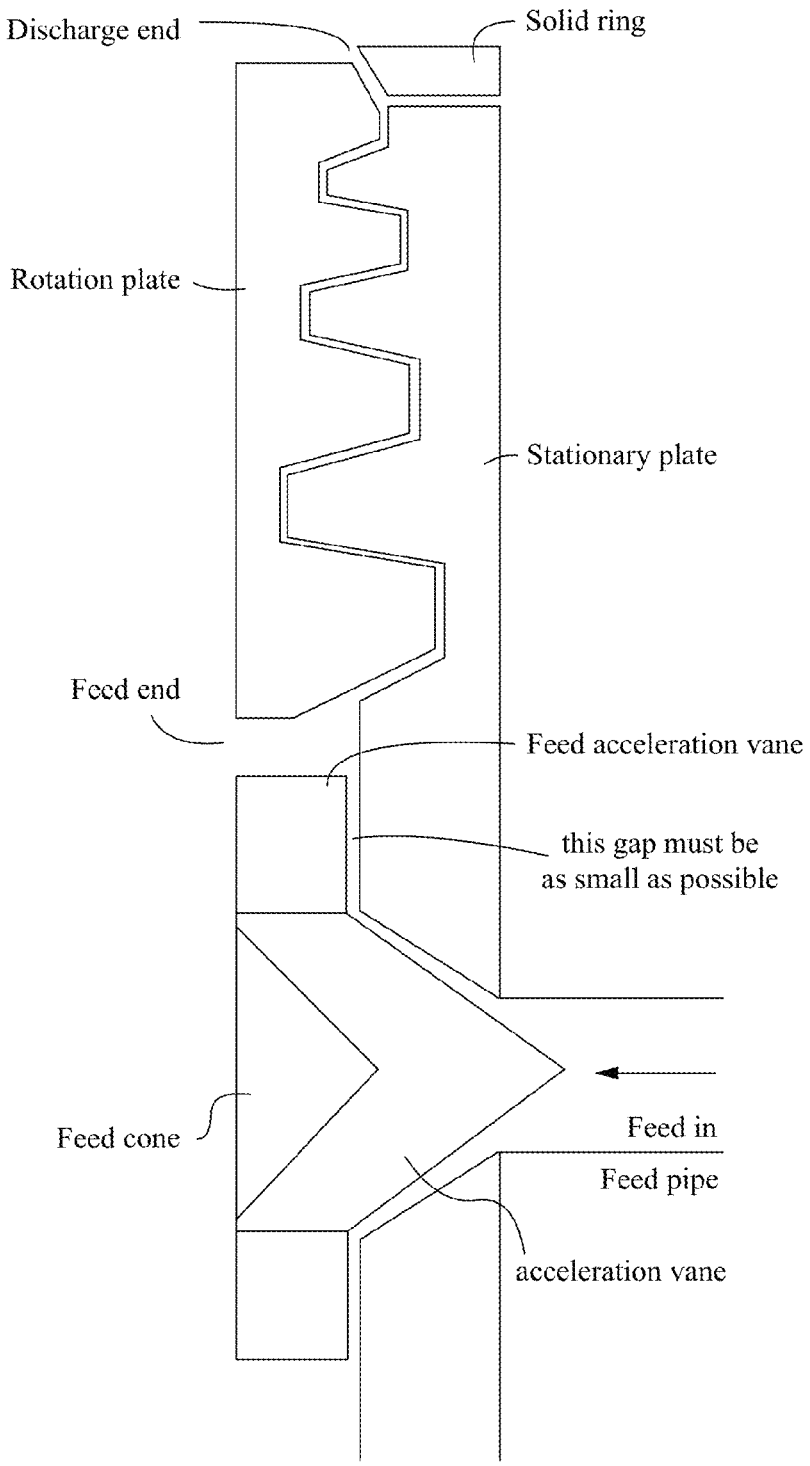
FIG. 15 illustrates a cut out side view of a portion of the grind mill.

The above discussion is primarily directed to grind plate design. For best grind operation, additional considerations are directed to how the solid material is continuously and consistently fed into the grind mill, pushed through gap between the two grind plates, and remains in the space between the two grind plates for the proper period of time before discharge. FIG. 15 illustrates a cut out side view of a portion of the grind mill. A solid ring is added on an outer edge of the grind plates to control the solid material discharge rate and to enable a specified solid material load. For continuous and consistent solid material feed through the gap between the two grind plates, a smooth acceleration vane is added to the feed cone at the feed pipe. In prior at grind mills, the acceleration of the input feed is very small and does not generate enough force to push through gap between two grind plates. In this case, the plate gap needs to be opened very wide to allow the solid material to flow through under the lower force. But with the wider plate gap, the active (over lap) grind surface area decreases sharply, and the grinding efficiency drops accordingly. A higher disc rotating speed will increase the grind efficiency. Accordingly, the grind mill design utilizes as high a speed as possible. The motor size is also increased because of the increase in the active (over lap) grind surface area and grind efficiency.

Figure 27:
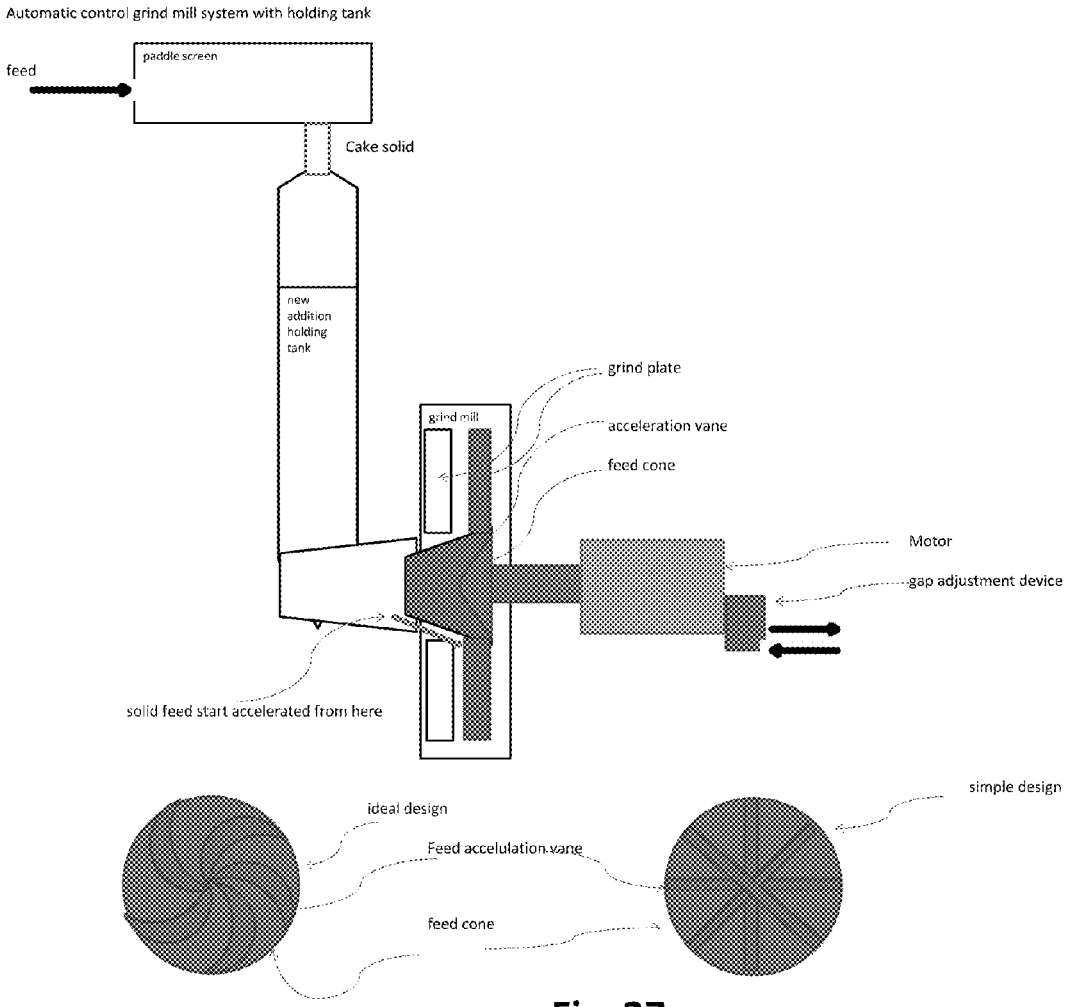
FIG. 27 illustrates an automatic control grind mill system with holding tank according to an embodiment.

FIG. 27 illustrates an automatic control grind mill system with holding tank according to an embodiment. An automatic control device is added to adjust the plate gap P to maintain a maximum motor amperage for maximum grinding capacity. But because there is a need in the dry mill application to grind the solid material as dry as possible, it is difficult to maintain the smooth and continuous feeding of drier solid material to the grind mill. As such, the motor amperage has a very wide swing, around 20% range, in normal operation. Accordingly, a solid material holding tank is added on top of the grind mill inlet, as shown in FIG. 27. The holding tank capacity is sufficient to provide an average solid material holding time of 10 to 60 seconds. In ideal operation, the rate of solid material flow out of the holding tank and through the grind disc is constant. However, in practice the flow often slows down or speeds up. When the rate slows, solid material backs up in the holding tank while new solid material is added to the holding tank from the holding tank input. As a result, the height of the solid material in the holding tank gradually increases, which in turn increases the pressure of the solid material at the acceleration vane, head pressure, thereby forcing more solid material into the grind plates. If the rate of solid material accumulating in the holding tank decreases, the height of the solid material in the holding tank gradually decreases, which in turn decreases the head pressure and forces less solid material into the grind plates. This self-regulation dampens the motor amperage wide swing problem in this application and enables the maximum motor amperage to be maintained.

The present application has been described in terms of specific embodiments incorporating details to facilitate the understanding of the principles of construction and operation of a grind mill. Many of the components shown and described in the various figures can be interchanged to achieve the results necessary, and this description should be read to encompass such interchange as well. As such, references herein to specific embodiments and details thereof are not intended to limit the scope of the claims appended hereto. It will be apparent to those skilled in the art that modifications can be made to the embodiments chosen for illustration without departing from the spirit and scope of the application.

What is claimed is:

1. A grind plate of a grind mill comprising:

a. a base plate having a first surface; and b a plurality of teeth aligned in a plurality of rows, each tooth extending from the first surface of the base plate, wherein each tooth comprises a tooth base width W along a radial axis of the grind plate and a tooth height H, and each tooth has a tooth height H-to-tooth base width W ratio in the range of 0.8 to 1.

2. The grind plate of claim 1 wherein each tooth has a tooth height H-to-tooth base width W ratio in the range of 0.95 to 1.

3. The grind plate of claim 1 wherein each row has a solid path way open area through which a solid material passes, further wherein a value of the solid path way open area is the same from row to row.

4. The grind plate of claim 3 wherein the solid path way open area for a specific row is an arc distance through a center of all the teeth in the specific row multiplied by the tooth height H minus a cross-sectional area of all the teeth in the specific row.

5. The grind plate of claim 1 wherein the teeth in a specific row are separated by a tooth separation distance D and each tooth has a tooth base length L along a direction of the specific row, and a ratio of the tooth separation distance D-to-the tooth base length L is in the range of 0.2 to 2.

6. The grind plate of claim 1 wherein the teeth in a specific row are separated by a tooth separation distance D and each tooth has a tooth base length L along a direction of the specific row, and a ratio of the tooth separation distance D-to-the tooth base length L is no greater than 2.

7. The grind plate of claim 1 wherein the teeth in each row are positioned according to a block channel configuration.

8. The grind plate of claim 1 wherein each tooth has a tooth base length L along a direction of the row, and a number of teeth in each row is selected so that the tooth base length L is in the range of 0.4 to 1.6 inch.

9. The grind plate of claim 1 wherein each tooth comprises a tooth base length L along a direction of the specific row, and a number of teeth in each row is selected so that the ratio of the tooth base length L-to-the tooth base width W is in the range of 0.4 to 1.2.

10. A grind mill for grinding a solid material, the dry mill comprising:

a. a plurality of first grind plates, each first grind plate having a plurality of teeth aligned in a plurality of first rows, wherein the plurality of first grind plates are coupled as a first grind disc; and b. a plurality of second grind plates, each second grind plate having a plurality of teeth aligned in a plurality of second rows, wherein the plurality of second grind plates are coupled as a second grind disc, further wherein the first grind disc and the second grind disc face each other to form alternating first and second rows of teeth having adjacent side surfaces separated by a side gap, wherein each tooth comprises a tooth base width W along a radial axis of the grind discs and a tooth height H, and each tooth has a tooth height H-to-tooth base width W ratio in the range of 0.8 to 1.

11. The grind mill of claim 10 wherein the grind mill is configured for a dry milling process.

12. The grind mill of claim 10 wherein each first row and each second row has a solid path way open area through which the solid material passes, further wherein a value of the solid path way open area is the same for all first and second rows.

13. The grind mill of claim 12 wherein the constant solid path way open area enables a constant capacity of solid material to be moved between the grind discs from a center of the grind discs to an outer perimeter of the grind discs thereby grinding the solid material.

14. The grind mill of claim 12 wherein the solid path way open area for a specific row is a circumference through a center of all the teeth in the specific row multiplied by a tooth height H minus a cross-sectional area of all the teeth in the specific row.

15. The grind mill of claim 12 wherein the teeth in a specific row are separated by a tooth separation distance D and each tooth has a tooth base length L along a direction of the specific row, wherein the value of the solid path way open area for the specific row is formed by adjusting a number of teeth for the specific row and a ratio of the tooth separation distance D-to-the tooth base length L for the specific row.

16. The grind mill of claim 10 wherein the teeth in a specific row are separated by a tooth separation distance D and each tooth has a tooth base length L along a direction of the specific row, and a ratio of the tooth separation distance D-to-the tooth base length L is different for each row.

17. The grind mill of claim 10 wherein the teeth in a specific row are separated by a tooth separation distance D and each tooth has a tooth base length L along a direction of the specific row, and a ratio of the tooth separation distance D-to-the tooth base length L is in the range of 0.2 to 2.

18. The grind mill of claim 10 wherein the teeth in a specific row are separated by a tooth separation distance D and each tooth has a tooth base length L along a direction of the specific row, and a ratio of the tooth separation distance D-to-the tooth base length L is no greater than 2.

19. The grind mill of claim 10 wherein the teeth in the plurality of first rows and the teeth in the plurality of second rows are positioned according to a block channel configuration.

20. The grind mill of claim 10 wherein each tooth in a specific row comprises a tooth base length L along a direction of the specific row and a number of teeth in the specific row is selected so that the tooth base length L is in the range of 0.4 to 1.6 inch.

21. The grind mill of claim 10 wherein each tooth in a specific row comprises a tooth base length L along a direction of the specific row, and a number of teeth in the specific row is selected so that the ratio of the tooth base length L-to-the tooth base width W is in the range of 0.4 to 1.2.

22. The grind mill of claim 10 wherein the teeth in a specific row are separated by a tooth separation distance D and each tooth has a tooth base length L along a direction of the specific row, further wherein a ratio of the tooth separation distance D-to-the tooth base length L increases from first and second rows having a larger radial distance to first and second rows having a smaller radial distance.

23. The grind mill of claim 10 further comprising a solid material inlet coupled to a center of the first and second grind discs.

24. The grind mill of claim 23 further comprising a solid material acceleration vane coupled to the center of the first and second grind plates and to the solid material inlet, wherein the solid material acceleration vane is configured to direct the solid material from the solid material inlet to the first and second grind discs.

25. The grind mill of claim 23 further comprising a solid material holding tank coupled to the solid material inlet, wherein the solid material holding tank is configured to self-adjust a feed rate of the solid material to the first and second grind discs.

26. The grind mill of claim 25 wherein the solid material holding tank is configured to maintain a maximum motor amperage of a motor driving the grind discs.

27. The grind mill of claim 10 further comprising an adjustment ring coupled to an outer perimeter of the first and second grind discs, wherein the adjustment ring is configured to adjust a plate gap P between the first grind disc and the second grind disc to control a solid material discharge rate and to enable a specified solid material load.

28. The grind mill of claim 10 wherein the first and second grind discs are 36 inch diameter grind discs.

29. The grind mill of claim 10 wherein the first grind disc and the second grind disc each comprise a two ring configuration, wherein a first ring comprises a plurality of inner-ring grind plates and a second ring comprises a plurality of outer-ring grind plates positioned around the plurality of inner-ring grind plates.

30. The grind mill of claim 29 wherein a tooth height H of the teeth in the first ring is different than a tooth height H of the teeth in the second ring.

31. The grind mill of claim 29 wherein a plate gap P between the inner ring of the first grind disc and the inner ring of the second grind disc is different than a plate gap P between the outer ring of the first grind disc and the outer ring of the second grind disc.

32. The grind mill of claim 10 wherein the first and second grind plates are tilt mounted relative to each other.

* * * * *